US010975893B2

(12) United States Patent
Fukuda et al.

(10) Patent No.: US 10,975,893 B2
(45) Date of Patent: Apr. 13, 2021

(54) HYDRAULIC SYSTEM FOR WORKING MACHINE

(71) Applicant: KUBOTA CORPORATION, Osaka (JP)

(72) Inventors: Yuji Fukuda, Osaka (JP); Toshihiko Takemura, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 24 days.

(21) Appl. No.: 16/149,794

(22) Filed: Oct. 2, 2018

(65) Prior Publication Data

US 2019/0101138 A1 Apr. 4, 2019

(30) Foreign Application Priority Data

Oct. 3, 2017 (JP) ..... JP2017-193601
Oct. 3, 2017 (JP) ..... JP2017-193602

(51) Int. Cl.

*F15B 11/16* (2006.01)
*F15B 13/02* (2006.01)
*F15B 13/06* (2006.01)
*E02F 9/22* (2006.01)

(Continued)

(52) U.S. Cl.

CPC ..... *F15B 11/16* (2013.01); *F15B 13/027* (2013.01); *F15B 13/028* (2013.01); *F15B 13/029* (2013.01); *F15B 13/06* (2013.01); *E02F 3/3414* (2013.01); *E02F 9/166* (2013.01); *E02F 9/2225* (2013.01); *E02F 9/2267* (2013.01); *E02F 9/2292* (2013.01); *F15B 2211/3052* (2013.01); *F15B 2211/30505* (2013.01); *F15B 2211/50581* (2013.01); *F15B 2211/526* (2013.01); *F15B 2211/6336* (2013.01);

(Continued)

(58) Field of Classification Search

CPC .... E02F 9/2228; F15B 11/166; F16H 61/431; F16H 61/433

See application file for complete search history.

(56) References Cited

U.S. PATENT DOCUMENTS 5,746,056 A * 5/1998 Smith ..... F16H 61/421 60/447
5,835,874 A * 11/1998 Hirata ..... E02F 3/435 701/50
9,702,119 B2 * 7/2017 Matsuyama ..... E02F 3/437

(Continued)

FOREIGN PATENT DOCUMENTS

DE 2150571 A1 * 6/1973 ..... F16H 61/4157
DE 4140860 A1 * 7/1993 ..... F16H 61/4008

(Continued)

*Primary Examiner* — Abiy Teka
*Assistant Examiner* — Matthew Wiblin
(74) *Attorney, Agent, or Firm* — Greenblum & Bernstein, P.L.C.

(57) ABSTRACT

A hydraulic system for a working machine includes a hydraulic pump to output an operation fluid, a hydraulic device to be operated by the operation fluid, an operation member to be operated, a first operation valve to regulate a pressure of the operation fluid in accordance with operation of the operation member, and a pressure supplying portion to supply a first counteracting pressure of the operation fluid against a first operation pressure, the first operation pressure being a pressure of the operation fluid regulated by the first operation valve.

8 Claims, 11 Drawing Sheets

(51) Int. Cl.
*E02F 9/16* (2006.01)
*E02F 3/34* (2006.01)

(52) U.S. Cl.
CPC ..... *F15B 2211/6346* (2013.01); *F15B 2211/7053* (2013.01); *F15B 2211/71* (2013.01)

(56) References Cited

U.S. PATENT DOCUMENTS

| | | | | |
|---|---|---|---|---|
| 2008/0078456 | A1* | 4/2008 | Thoms | E02F 9/226 137/488 |
| 2008/0184876 | A1* | 8/2008 | Nielsen | F15B 11/003 91/361 |
| 2010/0043421 | A1* | 2/2010 | Rub | F15B 11/162 60/421 |
| 2012/0260646 | A1* | 10/2012 | Nishikawa | E02F 9/2228 60/420 |
| 2015/0292184 | A1* | 10/2015 | Kondo | E02F 9/2203 60/463 |
| 2016/0215475 | A1* | 7/2016 | Meguriya | E02F 3/32 |

FOREIGN PATENT DOCUMENTS

| | | | | |
|---|---|---|---|---|
| DE | 102007051185 | A1 * | 4/2009 | F16H 61/433 |
| JP | 2002 221201 | A | 8/2002 | |
| JP | 2015-94443 | | 5/2015 | |
| JP | 2017-67100 | | 4/2017 | |
| JP | 2017 119975 | A | 7/2017 | |
| JP | 2017 518213 | A | 7/2017 | |
| WO | WO-2016138984 | A1 * | 9/2016 | F16H 61/4096 |
| WO | WO-2017212709 | A1 * | 12/2017 | E02F 9/2285 |

* cited by examiner

HYDRAULIC SYSTEM FOR WORKING MACHINE

CROSS-REFERENCE TO RELATED APPLICATIONS

The present application claims priority under 35 U.S.C. § 119 to Japanese Patent Application No. 2017-193601, filed Oct. 3, 2017 and to Japanese Patent Application No. 2017-193602, filed Oct. 3, 2017. The contents of these applications are incorporated herein by reference in their entirety.

BACKGROUND OF THE INVENTION

Field of the Invention

The present invention relates to a hydraulic system for a working machine.

Description of Related Art

A working machine disclosed in Japanese Unexamined Patent Publication No. 2017-67100 is previously known.

The hydraulic system for the working machine disclosed in Japanese Unexamined Patent Publication No. 2017-67100 includes an operation member, a hydraulic pump configured to output an operation fluid, a first fluid tube through which the operation fluid outputted from the hydraulic pump flows, an operation valve connected to the first fluid tube and configured to change a pressure of the operation fluid to be outputted in accordance with operation of the operation member, a hydraulic device configured to be operated by the operation fluid outputted from the operation valve, a second fluid tube connecting the operation valve and the hydraulic device to each other, and a reduction portion connected to the second fluid tube and configured to reduce a pressure of the operation fluid in the second fluid tube.

The working machine is conventionally operated by an operation system of either a hydraulic system or an electric system. For example, the working machine disclosed in Japanese Unexamined Patent Publication No. 2017-67100 includes an operation member, an operation valve configured to change a pressure of the operation fluid to be outputted in accordance with operation of the operation member, and a hydraulic device configured to be operated by the hydraulic fluid output from the operation valve.

In addition, the working machine disclosed in Japanese Unexamined Patent Publication No. 2015-94443 includes a control device configured to output a control signal on the basis of an operation extent of a first switch, the first switch being swingable, an electromagnetic valve configured to control a pilot pressure on the basis of the control signal, and a control valve configured to supply the hydraulic fluid to an actuator on the basis of the pilot pressure.

SUMMARY OF THE INVENTION

A hydraulic system for a working machine includes a hydraulic pump to output an operation fluid, a hydraulic device to be operated by the operation fluid, an operation member to be operated, a first operation valve to regulate a pressure of the operation fluid in accordance with operation of the operation member, and a pressure supplying portion to supply a first counteracting pressure of the operation fluid against a first operation pressure, the first operation pressure being a pressure of the operation fluid regulated by the first operation valve.

A hydraulic system for a working machine includes a hydraulic pump to output an operation fluid, a first hydraulic device to be operated by the operation fluid, an operation member to be operated, an operation valve having a rod to be moved depending on operation of the operation member, the operation valve being configured to change a pressure of the operation fluid based on movement of the rod, an electromagnetic valve to change the pressure of the operation fluid, and a changing portion. The changing portion includes a first state to allow any one of the operation valve and the electromagnetic valve to be activated, and a second state to allow both of the operation valve and the electromagnetic valve to be activated. The changing portion is selectively switched to the first state or the second state.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
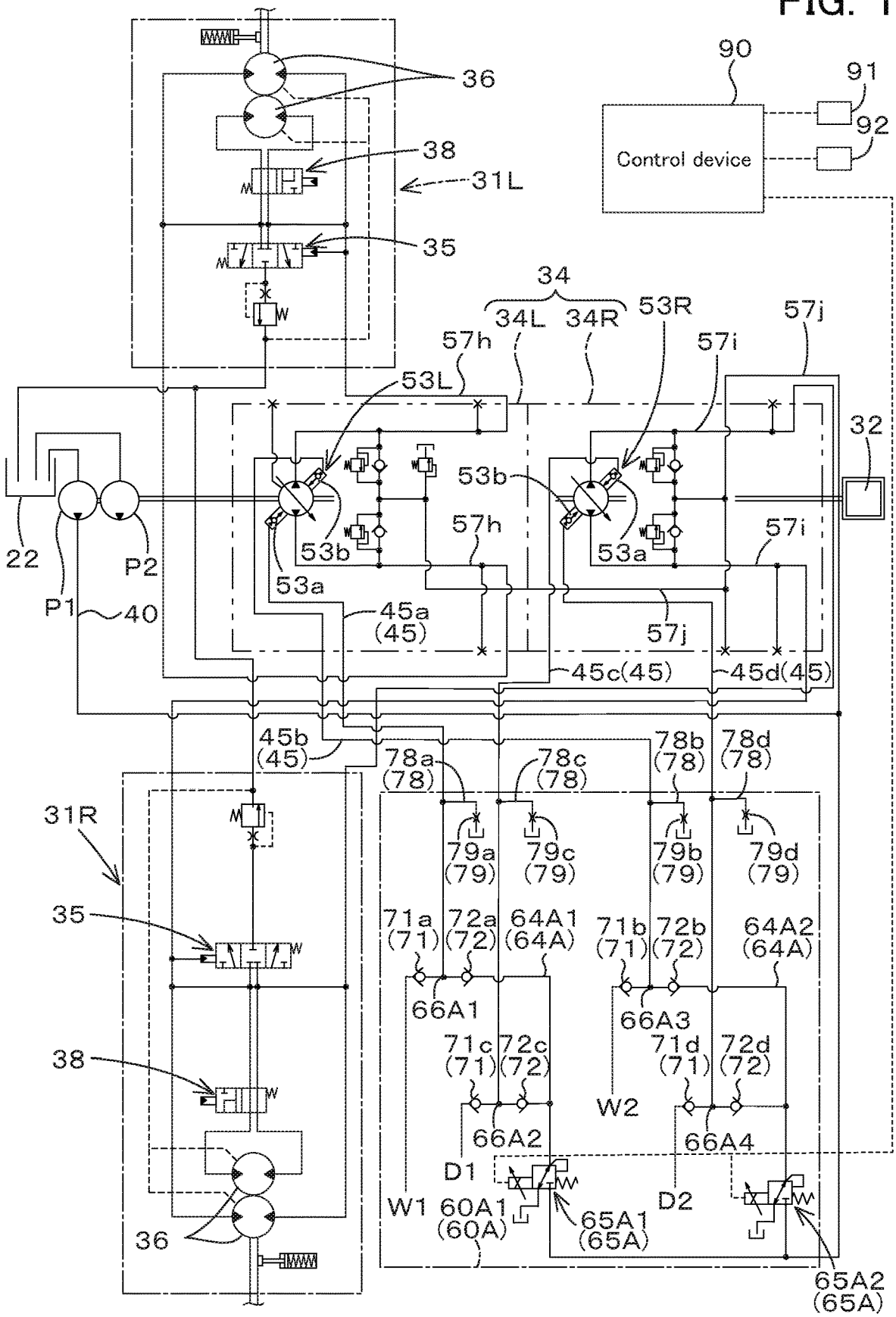
FIG. 1 is a schematic view of a hydraulic system of a traveling system according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

With reference to the drawings, a hydraulic system for a working machine 1 according to embodiments of the present invention will be described below.

First Embodiment

Hereinafter, a first embodiment of the present invention will be described with reference to the drawings.

Figure 10:
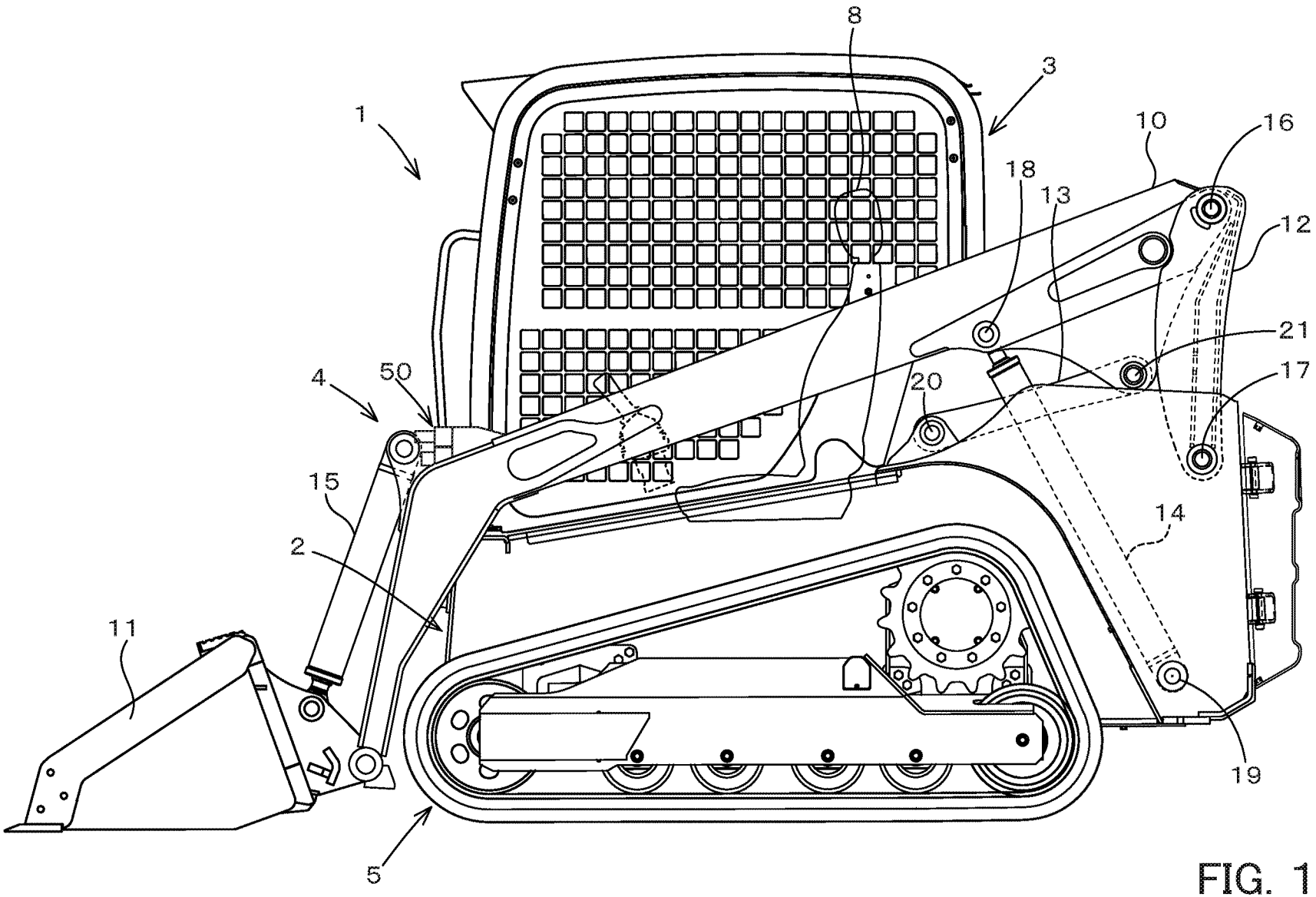
FIG. 10 is a side view illustrating a track loader according to the embodiments.

FIG. 10 shows a side view of the working machine according to the present invention. In FIG. 10, a compact track loader is shown as an example of the working machine.

However, the working machine according to the present invention is not limited to a compact track loader, and may be another type of loader working machine such as a skid steer loader, for example. In addition, the working machine according to the present invention may be a working machine other than the loader working machine.

Figure 11:
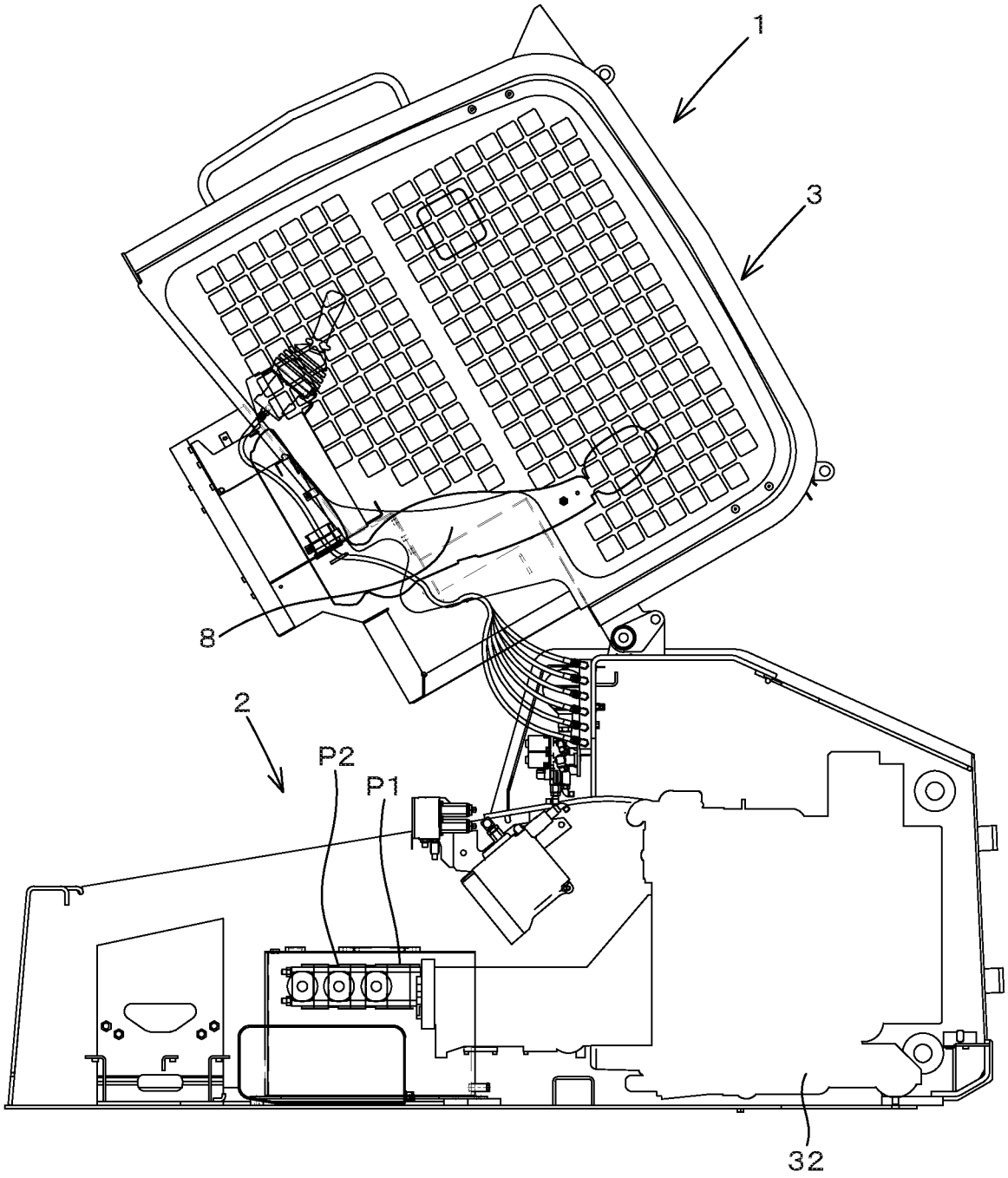
FIG. 11 is a side view of the track loader lifting up a cabin according to the embodiments.

As shown in FIG. 10 and FIG. 11, the working machine 1 includes a machine body 2, a cabin 3, a working device 4, and a traveling device 5.

In the embodiment of the present invention, the front side (the left side in FIG. 10) of an operator seated on the operator seat 8 of the working machine 1 is referred to as the front. The rear side (the right side in FIG. 10) of the operator is referred to as the right. The left side (the front surface side of FIG. 10) of the operator is referred to as the left. The right side (the back surface side of FIG. 10) of the operator is referred to as the right.

In addition, the horizontal direction which is orthogonal to a direction toward the front direction or a direction toward the rear direction will be described as a machine width direction. A direction from the center portion of the machine body 2 to the right portion or to the left portion will be described as a machine outward direction.

In other words, the machine outward direction is equivalent to the machine width direction, and is a direction separating away from the machine body 2. In the explanation of the embodiment, a direction opposite to the machine outward direction is referred to as the machine inward direction. In other words, the machine inward direction is equivalent to the machine width direction, and is a direction approaching the machine body 2.

The cabin 3 is mounted on the machine body 2. The cabin 3 is provided with the operator seat 8. The working device 4 is attached on the machine body 2. The traveling device 5 is provided outside the machine body 2. A prime mover 32 is mounted on the rear portion of the machine body 2.

The working device 4 includes a boom 10, a working tool 11, a lift link 12, a control link 13, a boom cylinder 14, and a bucket cylinder 15.

The boom 10 is provided on the right side of the cabin 3, and is configured to be swung vertically. Another boom 10 is provided on the left side of the cabin 3, and is configured to be swung vertically. The working tool 11 is, for example, a bucket, and the bucket 11 is provided at a tip end portion (a front end portion) of the boom 10, and is configured to be swung vertically.

The lift link 12 and the control link 13 support a base portion (a rear portion) of the boom 10 so that the boom 10 can be swung vertically. The boom cylinder 14 is stretched and shortened to move the boom 10 upward and downward. The bucket cylinder 15 is stretched and shorthand to swing the bucket 11.

A front portion of the boom 10 arranged on the left side is connected to a front portion of the boom 10 arranged on the right side by a deformed connecting pipe. The base portions (the rear portions) of the booms 10 are connected to each other by a circular connecting pipe.

The lift link 12, the control link 13 and the boom cylinder 14 are provided on the left side of the machine body 2, corresponding to the booms 10 arranged on the left. Another lift link 12, another other control link 13 and another boom cylinder 14 are provided on the right side of the machine body 2, corresponding to the booms 10 arranged on the right.

The lift link 12 is provided at the rear portion of the base portion of the boom 10 in the vertical direction. An upper portion (one end side) of the lift link 12 is pivotally supported by a pivot shaft (a first pivot shaft) 16 on a portion close to the rear portion of the base portion of the boom 10 so as to be rotatable around a lateral axis.

In addition, a lower portion (the other end side) of the lift link 12 is pivotally supported by a pivot shaft (a second pivot shaft) 17 at a position close to the rear portion of the machine body 2 so as to be rotatable around a lateral axis. The second pivot shaft 17 is provided below the first pivot shaft 16.

The upper portion of the boom cylinder 14 is pivotally supported by a pivot shaft (a third pivot shaft) 18 so as to be rotatable around the lateral axis. The third pivot shaft 18 is the base portion of the boom 10, and is provided at the front portion of the base portion.

The lower portion of the boom cylinder 14 is pivotally supported by a pivot shaft (a fourth pivot shaft) 19 so as to be rotatable around the lateral axis. The fourth pivot shaft 19 is provided on a portion close to a lower portion of the rear portion of the machine body 2 and below the third pivot shaft 18.

The control link 13 is provided in front of the lift link 12. One end of the control link 13 is pivotally supported by a pivot shaft (a fifth pivot shaft) 20 so as to be rotatable around the lateral axis. The fifth pivot shaft 20 is the machine body 2, and is provided at a position corresponding to the front of the lift link 12.

The other end of the control link 13 is pivotally supported by a pivot shaft (a sixth pivot shaft) 21 so as to be rotatable around the lateral axis. The sixth pivot shaft 21 is provided in front of the second pivot shaft 17 and above the second pivot shaft 17 in the boom 10.

As described above, the base portion of the boom 10 is supported by the lift link 12 and the control link 13. When the boom cylinder 14 is stretched or shortened, the boom 10 swings upward and downward around the first pivot shaft 16. In this manner, the tip end portion of the booms 10 moves up and down.

The control link 13 swings up and down around the fifth pivot shaft 20 in accordance with the swinging of the boom 10. When the control link 13 swings up and down, the lift link 12 swings forward or backward around the second pivot shaft 17.

Instead of the bucket 11, another working tool can be attached to the front portion of the boom 10. The other working tool is, for example, an attachment (an auxiliary attachment) such as a hydraulic crusher, a hydraulic breaker, an angle bloom, an earth auger, a pallet fork, a sweeper, a mower, a snow blower or the like.

A connecting member 50 is provided at the front portion of the boom 10 arranged on the left. The connecting member 50 is a device configured to connect the hydraulic device provided in the auxiliary attachment to the first piping material such as a pipe provided on the boom 10.

In particular, the first piping member can be connected to one end of the connecting member 50, and the second piping member connected to the hydraulic device of the auxiliary attachment can be connected to the other end of the connecting member 50. In this manner, the operation fluid flowing through the first piping member passes through the second piping member, and then is supplied to the hydraulic device.

The bucket cylinder 15 is arranged at a portion close to the front portion of the boom 10. The bucket 11 is swung due to the stretching and shortening of the bucket cylinder 15.

In the embodiment, the traveling device 5 arranged on the left employs a traveling device of a crawler type (including a semi-crawler type), and the traveling device 5 arranged on the right also employs the traveling device of a crawler type (including the semi-crawler type). Note that a traveling device of a wheel type having a front wheel and a rear wheel may be employed.

Next, a hydraulic system of a traveling system will be described.

As shown in FIG. 1, the hydraulic system includes a first hydraulic pump P1, a left traveling motor device (a first traveling motor device) 31L, a right traveling motor device (a second traveling motor device) 31R, the prime mover 32, and a traveling driving device 34.

The first hydraulic pump P1 is constituted of a pump driven by a motive power of the prime mover 32, and is constituted of a constant displacement type gear pump. The first hydraulic pump P1 is configured to output the operation fluid stored in the tank 22.

The first hydraulic pump P1 outputs the operation fluid that is mainly used for control. For convenience of the explanation, the tank 22 for storing the operation fluid may be referred to as an operation fluid tank.

In addition, among the operation fluid outputted from the first hydraulic pump P1, the operation fluid used for the control may be referred to as a pilot fluid, and a pressure of the pilot fluid may be referred to as a pilot pressure. A fluid tube (an outputting fluid tube) 40 through which the operation fluid (the pilot fluid) flows is provided on the outputting side of the first hydraulic pump P1.

The first traveling motor device 31L and the second traveling motor device 31R are provided in the outputting fluid tube (the first fluid tube) 40.

The prime mover 32 is constituted of an electric motor, an engine, and the like. In the embodiment, the prime mover 32 is an engine. It should be noted that the prime mover 32 may have a configuration of a hybrid type including the electric motor and the engine, or may have a configuration including only the electric motor.

The traveling driving device 34 is a device configured to drive the first traveling motor device 31L and the second traveling motor device 31R. The traveling driving device 34 includes a drive circuit (a left drive circuit) 34L for driving the first traveling motor device 31L and a drive circuit (a right drive circuit) 34R for driving the second traveling motor device 31R.

Each of the left driving circuit 34L and the right driving circuit 34R includes the traveling pumps (the traveling hydraulic pumps) 53L and 53R, the transmission fluid tubes 57*h* and 57*i*, and the second charging fluid tube 57*j*. The transmission fluid tubes 57*h* and 57*i* are fluid tubes connecting the traveling pumps 53L and 53R and the traveling motor 36 to each other.

The second charge fluid tube 57*j* is a fluid tube connected to the transmission fluid tubes 57*h* and 57*i*, and supplies the operation fluid outputted from the first hydraulic pump P1 to the transmission fluid tubes 57*h* and 57*i*.

Each of the traveling pumps 53L and 53R is constituted of a variable displacement axial pump of swash-plate type, the variable displacement axial pump being configured to be driven by the motive power of the prime mover 32. In other words, the traveling pumps 53L and 53R are traveling actuators configured to be operated by the operation fluid.

Each of the traveling pumps 53L and 53R includes a forward-traveling hydraulic receiving portion 53*a* and a backward-traveling hydraulic receiving portion 53*b* on which the pilot pressure is applied. The angles of the swash plates of the traveling pumps 53L and 53R are changed by the pilot pressures applied to the forward-traveling hydraulic receiving portion 53*a* and the reverse traveling hydraulic receiving portion 53*b*.

By changing the angle of the swash plate, it is possible to change the outputs (an output amount of the operation fluid) of the traveling pumps 53L and 53R and to change the output direction of the operation fluid.

The first traveling motor device 31L is constituted of a motor configured to transmit a power to the drive shaft of the traveling device 5 arranged on the left side of the machine body 2. The second traveling motor device 31R is constituted of a motor configured to transmit a power to the drive shaft of the travel device 5 arranged on the right side of the machine body 2.

The first traveling motor device 31L includes a traveling motor 36, a forward/backward direction switching valve 35, and a travel control valve (a hydraulic switching valve) 38. The operation fluid can be supplied to the traveling motor 36, the forward/backward direction switching valve 35, and the travel control valve 38.

The traveling motor 36 is constituted of a cam motor (a radial piston motor). The traveling motor 36 changes the rotation and torque of the output shaft by changing the displacement (the motor capacity) in the operation.

Next, the hydraulic system of the working system will be described.

Figure 2:
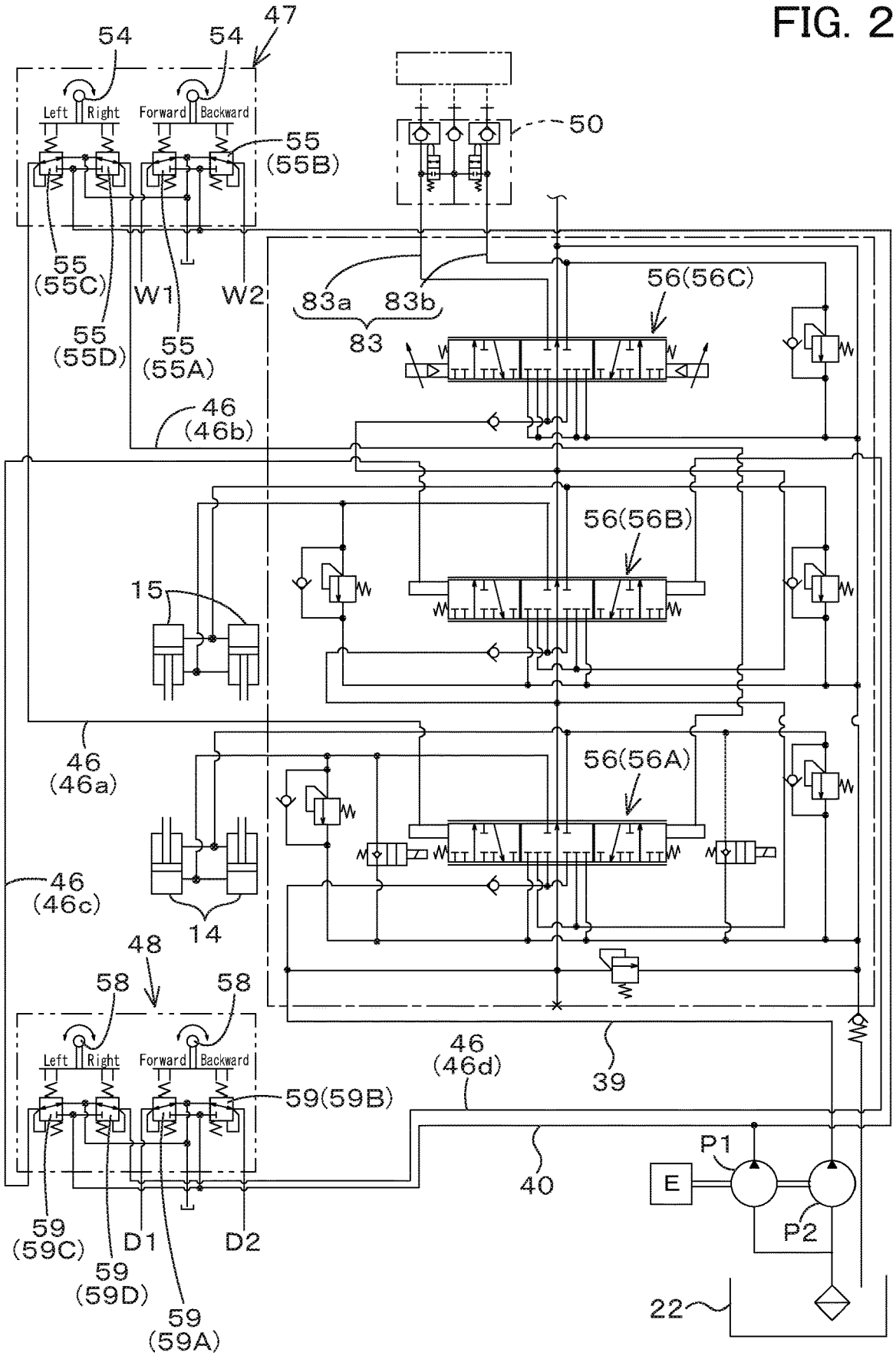
FIG. 2 is a schematic view of a hydraulic system of a working system according to the first embodiment.

As shown in FIG. 2, the hydraulic system includes a plurality of control valves 56 and a working system hydraulic pump (a second hydraulic pump) P2.

The second hydraulic pump P2 is constituted of a pump installed at a position different from that of the first hydraulic pump P1, and is constituted of a constant displacement type gear pump. The second hydraulic pump P2 is configured to output the operation fluid stored in the tank 22. The second hydraulic pump P2 outputs the operation fluid mainly used for operating the hydraulic actuator.

On the output side of the second hydraulic pump P2, a fluid tube (a main fluid tube) 39 is provided. A plurality of control valves 56 are connected to the main fluid tube 39. The control valves 56 are configured to switch the direction of flow of the operation fluid in accordance with the pilot pressure of the pilot fluid.

In addition, the control valve 56 controls (drives) a hydraulic device such as a boom, a bucket, a hydraulic crusher, a hydraulic breaker, an angle bloom, an earth auger, a pallet fork, a sweeper, a mower, a snow blower.

The plurality of control valves 56 include the first control valve 56A, the second control valve 56B, and the third control valve 56C. The first control valve 56A is a valve configured to control the hydraulic cylinder (the boom cylinder) 14 for controlling the boom.

The second control valve 56B is a valve configured to control the hydraulic cylinder (the bucket cylinder) 15 for controlling the bucket.

The third control valve 56 C is a valve for controlling the hydraulic device (the hydraulic cylinder, the hydraulic motor) attached to the auxiliary attachment such as a hydraulic crusher, a hydraulic breaker, an angle bloom, an earth auger, a pallet fork, a sweeper, a mower, a snow blower.

Each of the first control valve 56A and the second control valve 56B is constituted of a direct-acting, spool type three-position selector valve using a pilot pressure. The first control valve 56A and the second control valve 56B are switched by the pilot pressure to the neutral position, to the first position different from the neutral position, and to the second position different from the neutral position and the first position.

The first control valve 56A can be operated by the pressure difference of the operation fluids applied to the hydraulic receiving portion on one side of the first control valve 56A and the hydraulic receiving portion on the other side of the first control valve 56A.

In addition, the second control valve 56B can be operated by the pressure difference of the operation fluids applied to the hydraulic receiving portion on one side of the second control valve 56B and the hydraulic receiving portion on the other side of the second control valve 56B. The boom cylinder 14 is connected to the first control valve 56A by a fluid tube, and the bucket cylinder 15 is connected to the second control valve 56B by a fluid tube.

A supply/output fluid tube 83 is connected to the third control valve 56C. One end of the supply/output fluid tube 83 is connected to the supply/output port of the third control valve 56C. An intermediate portion of the fluid supply/output fluid tube 83 is connected to the connecting member 50. The other end portion of the fluid supply/output fluid tube 83 is connected to the hydraulic device of the auxiliary attachment.

In particular, the supply/output fluid tube 83 includes a first supply/output fluid tube 83*a* that connects the first supply/output port of the third control valve 56C to the first port of the connecting member 50.

In addition, the supply/output fluid tube 83 includes a second supply/output fluid tube 83*b* that connects the second supply/output port of the third control valve 56C to the second port of the connecting member 50.

In other words, by operating the third control valve 56C, the operation fluid can be supplied from the third control valve 56C toward the first supply/output fluid tube 83*a*. In addition, it is also possible to allow the operation fluid to flow from the third control valve 56C toward the second supply/output fluid tube 83*b*.

As shown in FIG. 1 and FIG. 2, the operation relating to traveling of the working machine 1 (the traveling operation) and the operation relating to the working (the working operation) are performed by the first operation device 47 provided on the left side of the operator seat 8 and the second operation device 48 provided on the right side of the operator seat 8.

In other words, the first operating device 47 and the second operating device 48 are operation devices for operating the hydraulic devices (the traveling motor 36, traveling pumps 53 L and 53 R) of the traveling system, the hydraulic devices of the working system (the first control valve 56A, the second control valve 56B, the third control valve 56C, the boom cylinder 14, the bucket cylinder 15, the hydraulic cylinder provided in the auxiliary attachment, and the hydraulic motor).

Next, the first operation device 47 and the second operation device 48 will be described in detail.

The first operating device 47 is a device configured to perform both of the traveling operation and the working operation, and includes a first operation member 54. The first operation member 54 is constituted of a lever, and is configured to perform the first operation for being moved in the forward direction or the backward direction and the second operation for being moved in the leftward direction or the rightward direction (in the machine width direction) different from the forward direction and the backward direction.

In other words, the first operation member 54 is constituted of a lever configured to be moved in one direction (for example, the forward, the leftward) and another direction (for example, the backward, the rightward) different from one direction.

In the first operation member 54, the first operation is assigned to the traveling operation, and the second operation is assigned to the working operation. That is, the first operation member 54 is used as an operation member for traveling (a traveling operation member) and as an operation member for working (a working member).

The first operation member 54 is not limited to a lever as long as it can perform at least the first operation and the second operation independently.

A plurality of pilot valves 55 are provided in a lower portion of the first operation member 54. The plurality of pilot valves 55 can change a pressure of the operation fluid in accordance with operation of the first operation member 54. The plurality of pilot valves 55 include the pilot valve 55A, the pilot valve 55B, the pilot valve 55C, and the pilot valve 55D.

The pilot valve 55A, the pilot valve 55B, the pilot valve 55C and the pilot valve 55D are connected to the outputting fluid tube 40.

The pilot valve 55A is a valve configured to be operated by a forward operation of the first operation (the operation in the forward direction or the backward direction), and to change a pressure of the operation fluid to be output in accordance with the operation extent (the operation) of the forward operation.

The pilot valve 55B is a valve configured to be operated by a backward operation of the first operation (the operation in the forward direction or the backward direction), and to change a pressure of the operation fluid to be output in accordance with the operation extent (the operation) of the backward operation.

That is, the pilot valve 55A and the pilot valve 55B are valves configured to be operated in the first operation, and perform an operation corresponding to the traveling operation.

The pilot valve 55C is a valve configured to be operated by a leftward operation of the second operation (an operation toward the left or an operation toward the right), and changes the pressure of the operation fluid to be output according to the operation extent (the operation) of the leftward operation.

The pilot valve 55D is a valve configured to be operated by a rightward operation of the second operation (the operation toward the left or the operation toward the right), and changes the pressure of the operation fluid to be output according to the operation extent (the operation) of the rightward operation.

That is, the pilot valve 55C and the pilot valve 55D are valves configured to be operated in the second operation, and perform the operations corresponding to the working operation.

The second operating device 48 is a device configured to perform both of the traveling operation and the working operation, and has a second operation member 58.

The second operation member 58 is a lever configured to perform a first operation for the forward movement or the backward movement and a second operation for the leftward movement and the rightward movement (in the machine width direction) different from the forward movement and the backward movement. In other words, the second operation member 58 is a lever configured to move in one direction (for example, the forward direction, the leftward direction) and in another direction (for example, the backward direction, the rightward direction) different from the one direction.

In the second operation member 58, the first operation is assigned to the traveling operation, and the second operation is assigned to the working operation. In other words, the second operation member 58 is used as an operation member for traveling (a traveling operation member) and used as an operation member for working (a working operation member).

Meanwhile, the second operation member 58 is not limited to the lever as long as the second operation member 58 can perform at least the first operation and the second operation independently.

A plurality of pilot valves 59 are provided on a lower portion of the second operation member 58. The plurality of pilot valves 59 can change the pressure of the operation fluid in accordance with the operation of the second operation member 58. The plurality of pilot valves 59 are the pilot valve 59A, the pilot valve 59B, the pilot valve 59C, and the pilot valve 59D.

The pilot valve 59A, the pilot valve 59B, the pilot valve 59C, and the pilot valve 59D are connected to the outputting fluid tube 40.

The pilot valve 59A is a valve configured to be operated by the forward operation of the second operation (the operation in the forward direction or the backward direction), and changes the pressure of the operation fluid to be output in accordance with the operation extent (the operation) of the forward operation.

The pilot valve 59B is a valve configured to be operated by the backward operation of the first operation (the operation in the forward direction or the backward direction), and changes the pressure of the operation fluid to be output in accordance with the operation extent (the operation) of the backward operation.

That is, the pilot valve 59A and the pilot valve 59B are valves configured to be operated in the first operation, and perform operations corresponding to the traveling operation.

The pilot valve 59C is a valve configured to be operated by the leftward operation of the first operation (the operation in the leftward direction or the rightward direction), and changes the pressure of the operation fluid to be output in accordance with the operation extent (the operation) of the leftward operation.

The pilot valve 59D is a valve configured to be operated by the rightward operation of the second operation (the operation in the leftward direction or the rightward direction), and changes the pressure of the operation fluid to be output in accordance with the operation extent (the operation) of the rightward operation.

That is, the pilot valve 59C and the pilot valve 59D are valves configured to be operated in the second operation, and perform operations corresponding to the working operation.

As described above, among the plurality of pilot valves, the pilot valve 55A, the pilot valve 55B, the pilot valve 59A, and the pilot valve 59B are operated in accordance with the traveling operation. In addition, the pilot valve 55C, the pilot valve 55D, the pilot valve 59C, and the pilot valve 59D are operated in accordance with the working operation.

For convenience of the explanation, the pilot valve 55A, the pilot valve 55B, the pilot valve 59A, and the pilot valve 59B may be referred to as a traveling pilot valve.

Among the traveling pilot valves, the pilot valve 55A configured to be operated by movement of the first operation member 54 in one direction (for example, forward) is referred to as a "first pilot valve". The pilot valve 55B configured to be operated by movement of the first operation member 54 in the other direction (for example, backward) is referred to as a "second pilot valve".

The pilot valve 59A configured to be operated by movement of the second operation member 58 in one direction (for example, forward) is referred to as a "third pilot valve". And, pilot valve 59B configured to be operated by movement of the second operation member 58 in the other direction (for example, backward) is referred to as a "fourth pilot valve".

Next, the relation between the traveling pilot valve, the working pilot valve, and the hydraulic device will be described. Reference numerals "W1", "W2", "D1", and "D2" shown in FIG. 1 and FIG. 2 indicate connection destinations of the fluid tubes.

The traveling pilot valve and the traveling pumps 53L and 53R, which are one type of the hydraulic devices for traveling (the traveling hydraulic devices), are connected to each other by a traveling fluid tube 45.

The travel fluid tube 45 includes a first travel fluid tube 45*a*, a second travel fluid tube 45*b*, a third travel fluid tube 45*c*, and a fourth travel fluid tube 45*d*.

The first travel fluid tube 45*a* is a fluid tube that connects the first pilot valve 55A and the forward-traveling hydraulic receiving portion 53*a* of the traveling pump 53L to each other. The second travel fluid tube 45*b* is a fluid tube that connects the second pilot valve 55B and the backward-traveling hydraulic receiving portion 53*b* of the traveling pump 53L to each other.

The third travel fluid tube 45*c* is a fluid tube that connects the third pilot valve 59A and the forward-traveling hydraulic receiving portion 53*a* of the traveling pump 53R to each other. The fourth travel fluid tube 45*d* is a fluid tube that connects the fourth pilot valve 59B and the backward-traveling hydraulic receiving portion 53*b* of the traveling pump 53R to each other.

When the first operation member 54 is tilted forward (to the front side), the first pilot valve 55A is operated to output the pilot pressure from the first pilot valve 55A. The pilot pressure is applied to the forward-traveling hydraulic receiving portion 53*a* of the traveling pump 53L.

When the second operation member 58 is tilted forward (to the front side), the third pilot valve 59A is operated to output the pilot pressure from the third pilot valve 59A. The pilot pressure is applied to the forward-traveling hydraulic receiving portion 53*a* of the traveling pump 53R.

When the first operation member 54 is tilted backward (to the rear side), the second pilot valve 55B is operated to output the pilot pressure from the second pilot valve 55B. The pilot pressure is applied to the backward-traveling hydraulic receiving portion 53*b* of the traveling pump 53L.

When the second operation member 58 is tilted backward (to the rear side), the fourth pilot valve 59B is operated to output the pilot pressure from the fourth pilot valve 59B. The pilot pressure is applied to the backward-traveling hydraulic receiving portion 53*b* of the traveling pump 53R.

Thus, when the first operation member 54 and the second operation member 58 are swung forward, the traveling motor (the HST motor) 36 revolves forward at a speed proportional to the swinging extents of the first operation member 54 and the second operation member 58. As the result, the working machine 1 travels straight forward.

When the first operation member 54 and the second operation member 58 are swung backward, the traveling motor 36 rotates backward at a speed proportional to the swinging extents of the first operation member 54 and the second operation member 58. As the result, the working machine 1 travels straight backward.

In addition, when one of the first operation member 54 and the second operation member 58 is swung forward and the other is swung backward, the traveling motor 36 arranged to the left and the traveling motor 36 arranged to the right revolve in directions mutually different from each other. As the result, the working machine 1 turns to the right or to the left.

As described above, by moving the first operation member 54 in the forward direction or in the backward direction or by moving the second operation member 58 in the forward direction or in the backward direction, the traveling operation to move the working machine 1 forward, backward, rightward, and leftward can be performed.

In addition, the working pilot valve and the control valve 56 that is one of the hydraulic devices for working (the working hydraulic devices) are connected to each other by an operation fluid tube 46. The operation fluid tube 46 has a first operation fluid tube 46*a*, a second operation fluid tube 46*b*, a third operation fluid tube 46*c*, and a fourth operation fluid tube 46*d*.

The first operation fluid tube 46*a* is a fluid tube that connects the pilot valve 55C and the hydraulic receiving portion of the first control valve 56A to each other. The second operation fluid tube 46*b* is a fluid tube that connects the pilot valve 55D and the hydraulic receiving-portion of the first control valve 56A to each other.

The third operation fluid tube 46*c* is a fluid tube that connects the pilot valve 59C and the hydraulic receiving portion of the second control valve 56B to each other. The fourth operation fluid tube 46*d* is a fluid tube that connects the pilot valve 59D and the hydraulic receiving portion of the second control valve 56B to each other.

When the first operation member 54 is tilted leftward (to the left side), the pilot valve 55C is operated to set the pilot pressure of the pilot fluid outputted from the pilot valve 55C. The pilot pressure is applied to the hydraulic receiving portion of the first control valve 56A, and the boom cylinder 14 is stretched. The stretching of the boom cylinder 14 moves the boom 10 upward.

When the first operation member 54 is tilted rightward (to the right side), the pilot valve 55D is operated to set the pilot pressure of the pilot fluid outputted from the pilot valve 55D. The pilot pressure is applied to the hydraulic receiving portion of the first control valve 56A, and the boom cylinder 14 is shortened. The shortening of the boom cylinder 14 moves the boom 10 downward.

When the second operation member 58 is tilted leftward (to the left side), the pilot valve 59C is operated to set the pilot pressure of the pilot fluid outputted from the pilot valve 59C. The pilot pressure is applied to the hydraulic receiving portion of the second control valve 56B, and the bucket cylinder 15 is shortened. The shortening of the bucket cylinder 15 forces the bucket 11 to perform the shoveling operation.

When the second operation member 58 is tilted rightward (to the right side), the pilot valve 59D is operated to set the pilot pressure of the pilot fluid outputted from the pilot valve 59D. The pilot pressure is applied to the hydraulic receiving portion of the second control valve 56B, and the bucket cylinder 15 is stretched. The stretching of the bucket cylinder 15 forces the bucket 11 to perform the dumping operation.

Thus, by moving the first operation member 54 in the left direction or in the right direction or by moving the second operation member 58 in the left direction or in the right direction, it is possible to perform the working operations such as the upward/downward moving of the boom 10, the dumping operation of the bucket, or the shoveling operation of the bucket can be performed.

Meanwhile, the hydraulic system for the working machine 1 is provided with a pressure supplying portion 60A. The pressure supplying portion 60A can supply the operation fluid (the pilot fluid) to the traveling pumps 53L and 53R which are the hydraulic devices, and thereby the pressure supplying portion 60A can reduce the output power of the traveling pumps 53L and 53R.

In particular, the pressure supplying portion 60A applies the pressure of the operation fluid against the pressure of the operation fluid that is set by the first operation valve on the basis of the operation of the operation member.

In the present embodiment, the pressure supplying portion 60A applies the pressure of the operation fluid against the pressure of the operation fluid that is set by any one of the pilot valves 55A and 55B and the pilot valves 59A and 59B on the basis of the operations of the first operation member 54 and the second operation member 58 that are the operation members.

For convenience of the explanation, in the hydraulic receiving portions 53*a* and 53*b* of the traveling pumps 53L and 53R, one of the hydraulic receiving portions 53*a* and 53*b* may be referred to as a "first hydraulic receiving portion", and the other one of the hydraulic receiving portions 53*a* and 53*b* may be referred to as a "second hydraulic receiving portion".

In addition, the operation valves that apply the pressure of the operation fluid to the first hydraulic receiving portion, that is, the pilot valves 55A and 59A may be referred to as "first operation valves". Further, the operation valves that apply the pressure of the operation fluid to the second hydraulic receiving portion, that is, the pilot valves 55B and 59B may be referred to as "second operation valves".

Also, the pressure of the operation fluid set by the first operation valve, that is, the pressures of the operation fluid applied to the first hydraulic receiving portion may be referred to as a "first operation pressure". Further, the pressure of the operation fluid set by the second operation valve, that is, the pressures of the operation fluid applied to the second hydraulic receiving portion may be referred to as a "second operation pressure".

In addition, the pressures set by the first operation valve and the second operation valve, that is, the pressures applied to the first hydraulic receiving portion and the second hydraulic receiving portion are referred to as the "pilot pressure".

The pressure supplying portion 60A supplies a first counter pressure to the second hydraulic receiving portion 53*b* against the first operation pressure (the pilot pressure applied to the first hydraulic receiving portion 53*a*) set by the first operation valves 55A and 59A.

For example, in the case where the first operation valve 55A adjusts the first operation pressure due to the operation of the first operation member 54, the first operation pressure being the pilot pressure applied to the first hydraulic receiving portion 53*a* of the traveling pump 53L, the pressure supplying portion 60A applies the pilot pressure serving as the first counter pressure to the second hydraulic receiving portion 53*b* of the traveling pump 53L.

In addition, in the case where the first operation valve 59A adjusts the first operation pressure due to the operation of the second operation member 58, the second operation pressure being the pilot pressure applied to the first hydraulic receiving portion 53*a* of the traveling pump 53R, the pressure supplying portion 60A applies the pilot pressure serving as the first counter pressure to the second hydraulic receiving portion 53*b* of the traveling pump 53R.

Thus, in the case where the first operation pressure is set to the first hydraulic receiving portion 53*a* by one of the first operation valves 55A and 59A, the pressure supplying portion 60A applies the first counter pressure against the first operation pressure to the second hydraulic receiving portion 53*b* opposite to the first hydraulic receiving portion 53*a*.

In addition, the pressure supplying portion 60A applies (applies) the second counter pressure to the first hydraulic receiving portion 53*a* against the second operation pressure (the pilot pressure applied to the second hydraulic receiving portion 53*b*) set by the second operation valves 55B and 59B.

For example, in the case where the second operation valve 55B adjusts the second operation pressure due to the operation of the first operation member 54, the second operation pressure being the pilot pressure applied to the second hydraulic receiving portion 53*b* of the traveling pump 53L, the pressure supplying portion 60A applies the pilot pressure serving as the first counter pressure to the first hydraulic receiving portion 53*a* of the traveling pump 53L.

In addition, in the case where the second operation valve 59B adjusts the second operation pressure due to the operation of the second operation member 58, the second operation pressure being the pilot pressure applied to the second hydraulic receiving portion 53*b* of the traveling pump 53R, the pressure supplying portion 60A applies the pilot pressure serving as the first counter pressure to the first hydraulic receiving portion 53*a* of the traveling pump 53R.

Thus, in the case where the second operation pressure is set to the second hydraulic receiving portion 53*b* by one of the second operation valves 55B and 59B, the pressure supplying portion 60A applies the second counter pressure against the second operation pressure to the first hydraulic receiving portion 53*a* opposite to the second hydraulic receiving portion 53*b*.

Hereinafter, the pressure supplying portion 60A will be described in detail.

The pressure supplying portion 60A includes a first supply fluid tube and a second supply fluid tube. The first supply fluid tube is a fluid tube connecting the pilot valves 55A and 59A to the hydraulic receiving portions 53*a* of the traveling pumps 53L and 53R. In particular, the first supply fluid tube is the travel fluid tube 45. The second supply fluid tube is a fluid tube connecting the pilot valves 55B and 59B to the hydraulic receiving portions 53*b* of the traveling pumps 53L and 53R.

In addition, the pressure supplying portion 60A includes a plurality of branched fluid tubes 64A and a plurality of operation valves 65A. The plurality of branched fluid tubes 64A are connected to the first hydraulic pump (the hydraulic pump) P1, and are confluent with (connected to) the traveling fluid tube 45. The plurality of operation valves 65A are provided in the branched fluid tube 64A and apply the pressure of the operation fluid to the branched fluid tube 64A.

The plurality of operation valves 65A include a first operation valve 65A1 and a second operation valve 65A2. The plurality of branched fluid tubes 64A include a first branched fluid tube 64A1 and a second branched fluid tube 64A2.

The first branched fluid tube 64A1 is a fluid tube which is connected to the first hydraulic pump (the hydraulic pump) P1 and is confluent with (connected to) the first travel fluid tube 45*a* and the third traveling fluid tube 45*c*. The first branched fluid tube 64A1 is provided with a first operation valve 65A1. The first operation valve 65A1 is an electromagnetic proportional valve (a proportional valve) whose an opening aperture can be changed by magnetizing the solenoid.

When the opening aperture of the proportional valve 65A1 is changed from the fully closed state, the proportional valve 65A1 can apply the pilot pressure to the first hydraulic receiving portion 53*a* of the traveling pump 53L and to the first hydraulic receiving portion 53*a* of the traveling pump 53R through the first traveling fluid tube 45*a* and the third traveling fluid tube 45*c*.

In particular, in the case where the second operation pressure is applied to the second hydraulic receiving portion 53*b* of the traveling pump 53L by the operation of the first operation member 54, the first operation valve 65A1 changes the opening aperture from the fully closed state. As the result, the second counter pressure against the second operation pressure is applied to the first hydraulic receiving portion 53*a* of the traveling pump 53L by the operation of the first operation valve 65A1.

In addition, in the case where the second operation pressure is applied to the second hydraulic receiving portion 53*b* of the traveling pump 53R by the operation of the second operation member 58, the opening aperture of the first operation valve 65A1 is changed from the fully closed state. As the result, the second counter pressure against the second operation pressure is applied to the first hydraulic receiving portion 53*a* of the traveling pump 53R by the operation of the first operation valve 65A1.

Meanwhile, a pressure lower than the second operation pressure is set as the second counter pressure set by the first operation valve 65A1. In addition, in the case where the second operation pressure is not applied to the second hydraulic receiving portion 53*b* of the traveling pumps 53L and 53R, the first operation valve 65A1 is fully closed, and thus the second counter pressure is not supplied.

As described above, according to the first operation valve 65A1, in the case where the second operation valves 55B and 59B are operated, the second counter pressure against the second operation pressure set by the second operation valves 55B and 59B is applied to the traveling pumps 53L and 53R. In this manner, it is possible to lower the output powers of the traveling pumps 53L and 53R without discharging the pilot fluid.

The second branched fluid tube 64A2 is a fluid tube connected to the first hydraulic pump (the hydraulic pump) P1 and is confluent with (connected to) the second traveling fluid tube 45*b* and the fourth traveling fluid tube 45*d*. The second branched fluid tube 64A2 is provided with a second operation valve 65A2. The second operation valve 65A2 is constituted of a electromagnetic proportional valve (a solenoid proportional valve), and it is possible to change the opening aperture by magnetizing the solenoid.

When the opening aperture of the proportional valve 65A2 is changed from the fully closed state, the proportional valve 65A2 can apply the pilot pressure to the second hydraulic receiving portion 53*b* of the traveling pump 53L and to the second hydraulic receiving portion 53*b* of the traveling pump 53R through the second traveling fluid tube 45*b* and the fourth traveling fluid tube 45*d*.

In particular, in the case where the first operation pressure is applied to the first hydraulic receiving portion 53*a* of the traveling pump 53L by the operation of the first operation member 54, the second operation valve 65A2 changes the opening aperture from the fully closed state.

As the result, the first counter pressure against the first operation pressure is applied to the second hydraulic receiving portion 53*b* of the traveling pump 53L by the operation of the second operation valve 65A2.

In addition, in the case where the first operation pressure is applied to the first hydraulic receiving portion 53*a* of the traveling pump 53R by the operation of the second operation member 58, the second operation valve 65A2 changes the opening aperture from the fully closed state.

As the result, the first counter pressure against the first operation pressure is applied to the second hydraulic receiving portion 53*b* of the traveling pump 53R by the operation of the second operation valve 65A2.

A pressure smaller than the first operation pressure is set as the first counter pressure set by the second operation valve 65A2. In addition, in the case where the first operation pressure is not applied to the first hydraulic receiving portion 53*a* of the traveling pumps 53L and 53R, the second operation valve 65A2 is fully closed, and thereby the first countering pressure is not supplied.

As described above, according to the second operation valve 65A2, in the case where the first operation valves 55A and 59A are operated, the first counter pressure against the first operation pressure set by the first operation valves 55A and 59A is applied to the traveling pumps 53L and 53R. Thus, it is possible to lower the output power of the traveling pumps 53L and 53R without discharging the pilot fluid.

The traveling fluid tube 45 includes a plurality of first check valves 71 and a plurality of second check valves 72. The plurality of first check valves 71 are provided between the first operation valves 55A and 59A and the confluent portion where the traveling fluid tube 45 and the branched fluid tube 64A are confluent with (connected to) each other. To explain more specifically, the first check valves 71 include first check valves 71*a*, 71*b*, 71*c*, and 71*d*.

The first check valve 71*a* is provided in the traveling fluid tube 45*a* between the first operation valve 55A and the first confluent portion 66A1 where the travel fluid tube 45*a* and the branched fluid tube 64A1 are confluent with (connected to) each other. The first check valve 71*c* is provided in the traveling fluid tube 45*c* between the first operation valve 59A and the second confluent portion 66A2 where the travel fluid tube 45*c* and the branched fluid tube 64A1 are confluent with (connected to) each other.

The first check valve 71*b* is provided in the traveling fluid tube 45*b* between the second operation valve 55B and the third confluent portion 66A3 where the travel fluid tube 45*b* and the second branched fluid tube 64A2 are confluent with (connected to) each other. The first check valve 71*d* is provided in the traveling fluid tube 45*d* between the second operation valve 59B and the fourth confluent portion 66A4 where the travel fluid tube 45*d* and the second branched fluid tube 64A2 are confluent with (connected to) each other.

The first check valve 71 allows the operation fluid to flow from the operation valves (the pilot valves) 55A, 55B, 59A, and 59B toward the confluent portions 66A1, 66A2, 66A3, and 66A4. In addition, the first check valve 71 regulates the flow of operation fluid flowing from the confluent portions 66A1, 66A2, 66A3, and 66A4 toward the operation valves 55A, 55B, 59A, and 59B.

In addition, the second check valve 72 is provided in the branched fluid tube 64A. The second check valve 72 includes second check valves 72*a*, 72*b*, 72*c*, and 72*d*. The second check valves 72*a* and 72*c* are provided in the branched fluid tube 64A1. The second check valves 72*b* and 72*d* are provided in the second branched fluid tube 64A2.

The second check valve 72 allows the operation fluid to flow from the operation valve 65A toward the confluent portions 66A1, 66A2, 66A3, and 66A4. In addition, the second check valve 72 regulates the flow of the operation fluid flowing from the confluent portions 66A1, 66A2, 66A3, and 66A4 toward the operation valve 65A.

As shown in FIG. 1, the traveling fluid tube 45 includes a plurality of outputting fluid tubes 78 and a plurality of throttles 79. The outputting fluid tube 78 is branched from a section between the traveling pumps 53L and 53R and the junction portions 66A1, 66A2, 66A3, and 66A4 of the traveling fluid tube 45, and discharges the operation fluid. The outputting fluid tube 78 includes outputting fluid tubes 78*a*, 78*b*, 78*c*, and 78*d*.

The plurality of throttle 79 reduce the flow rate of operation fluid. The throttle 79 is constituted, for example, by making a part of each of the outputting fluid tubes 78*a*, 78*b*, 78*c*, and 78*d* narrower than the other parts. In other words, the cross-sectional areas of the portions through which the operation fluid flows in the outputting fluid tubes 78*a*, 78*b*, 78*c*, and 78*d* is made smaller than the cross-sectional areas of the other portions.

The outputting fluid tube 78*a* is a fluid tube that is branched off between the confluent portion 66A1 and the hydraulic receiving portion 53*a* in the first travel fluid tube 45*a*. A throttle 79*a* is provided in the middle of the outputting fluid tube 78*a*.

The outputting fluid tube 78*c* is a fluid tube that is branched off between the confluent portion 66A2 and the hydraulic receiving portion 53 *a* in the third travel fluid tube 45*c*. A throttle 79*c* is provided in the middle of the outputting fluid tube 78*c*.

The outputting fluid tube 78*b* is a fluid tube that is branched off between the first confluent portion 66A3 and the hydraulic receiving portion 53*b* in the second travel fluid tube 45*b*. A throttle 79*b* is provided in the middle of the outputting fluid tube 78*b*.

The outputting fluid tube 78*d* is a fluid tube that is branched off between the first confluent portion 66A4 and the hydraulic receiving portion 53*h* in the fourth travel fluid tube 45*d*. A throttle 79*d* is provided in the middle of the outputting fluid tube 78*d*.

That is, a part of the operation fluid flowing in the traveling fluid tube 45 can be outputted to the tank 22 through the outputting fluid tube 78 and the throttle 79.

The opening aperture of the operation valve 65*a* is changed by the control device 90. A detection device 91 configured to detect the load of the prime mover 32 is connected to the control device 90. For example, the detection device 91 receives the engine revolutions speed as an index indicating the load of the prime mover 32.

The control device 90 outputs a control signal for opening the operation valve 65A (the first operation valve 65A1 and the second operation valve 65A2) in the case where the engine revolutions speed becomes equal to or lower than a predetermined value. As the result, the operation valve 65*a* is opened, and the first counter pressure and the second counter pressure are applied to the hydraulic receiving portions 53*a* and 53*b* as described above. In this manner, it is possible to lower the output power of the traveling pumps 53L and 53R.

Thus, the engine stall can be prevented by the operation valve 65A. Meanwhile, in the case where the load of the prime mover 32 may be measured directly and the load of the prime mover 32 becomes equal to or greater than the predetermined value, the operation valve 65A may be operated. In this manner, the first counter pressure and the second counter pressure can be applied to the hydraulic receiving portions 53*a* and 53*b*.

The control device 90 has a warm-up mode. The warm-up mode is a mode in which the hydraulic circuit for operating is warmed up without activating the traveling device of the working machine 1.

The warm-up mode will be described in detail. In the warm-up mode, the control device 90 controls the pressure of the operation fluid that has passed through the forward operation valve 65A1 and reaches the first traveling fluid tube 45*a* and the second traveling fluid tube 45*b* and the pressure of the operation fluid that has passed through the second operation valve 65A2 and reaches the third traveling fluid tube 45*c* and the fourth traveling fluid tube 45*d* both are set to a pressure lower than the pressure at which the traveling pumps 53L and 53R are activated.

The operation fluid that has passed through the traveling fluid tube (the first supply fluid tube) 45 is outputted to the tank 22 through the outputting fluid tube 78 and the throttle 79. Since the operation fluid flows to the supply fluid tube at a pressure lower than the pressure at which the traveling pumps 53L and 53R are activated, the traveling device is not activated.

That is, in the warm-up mode, the working machine 1 warms up the hydraulic circuit of operating while stopping.

The switching to the warm-up mode is performed by the switch 92 connected to the control device 90. The switch 92 is a member instructing the control device 90 to switch to the warm-up mode. When the switch 92 is pressed, a signal instructing the switching to the warm-up mode is output to the control device 90.

On the other hand, when the switch 92 is pressed again, the warm-up mode is canceled. The switch 92 is constituted of a push button switch 92 such as a momentary switch, an alternate switch, or the like. Meanwhile, it should be noted that the switch 92 is not limited to the push button switch 92 such as the momentary switch and the push button switch 92, and may be constituted of any switch 92 as long as the switch 92 outputs a signal to the control device 90.

Accordingly, the operation fluid can be outputted from the outputting fluid tube 78 without operating the traveling pumps 53L and 53R. Thus, it is possible to warm up the fluid tube for the operation system even when the working machine 1 is not in the moving operation or in the working operation.

Figure 3:
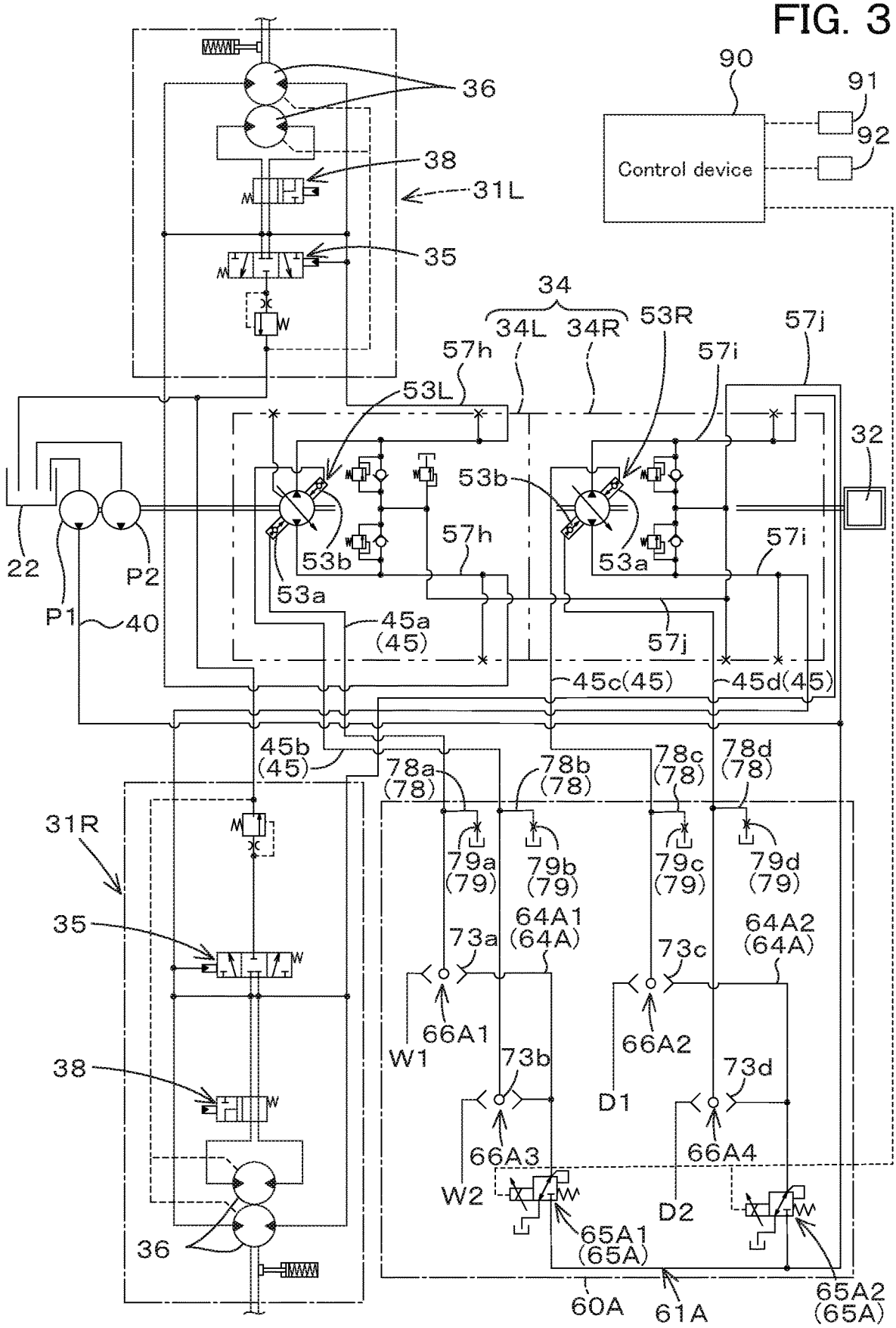
FIG. 3 is a schematic view illustrating a modified example of the hydraulic system of the traveling system according to the first embodiment.

FIG. 3 shows a modified example of the first embodiment. In the modified example of FIG. 3, the first branched fluid tube 64A1 is connected to the first travel fluid tube 45*a* and the second traveling fluid tube 45*b*, and the second branched fluid tube 64A2 is connected to the third traveling fluid tube 45*c* and the fourth traveling fluid tube 45*b*. The first branched fluid tube 64A1 is provided with a first operation valve 65A1, and the second branched fluid tube 64A2 is provided with a second operation valve 65A2.

The pressure supplying portion 60A has a plurality of high pressure selection valves (a plurality of shuttle valves). The plurality of high pressure selection valves are valves configured to transmit higher pressure among at least two inputted pressures. The plurality of high pressure selection valves include high pressure selection valves 73*a*, 73*b*, 73*c*, and 73*d*.

The high pressure selection valve 73*a* is provided in the confluent portion 66A1. The high pressure selection valve 73*b* is provided in the confluent portion 66A2. The high pressure selection valve 73*c* is provided in the confluent portion 66A3. The high pressure selection valve 73*d* is provided in the confluent portion 66A4.

In the modified example of FIG. 3, in the case where the second operation pressure is applied to the second hydraulic receiving portion 53*b* of the traveling pump 53L by the operation of the first operation member 54, the first operation valve 65A1 changes the opening aperture from the fully closed state. As the result, the second counter pressure against the second operation pressure can be applied to the first hydraulic receiving portion 53*a* of the traveling pump 53L by the operation of the first operation valve 65A1.

In addition, in the case where the second operation pressure is applied to the second hydraulic receiving portion 53*b* of the traveling pump 53R by the operation of the second operation member 58, the second operation valve 65A2 changes the opening aperture from the fully closed state. As the result, by the operation of the second operation valve 65A2, the second counter pressure against the second operation pressure can be applied to the first hydraulic receiving portion 53*a* of the traveling pump 53R.

In the case where the first operation pressure is applied to the first hydraulic receiving portion 53*a* of the traveling pump 53L by the operation of the first operation member 54, the first operation valve 65A1 changes the opening aperture from the fully closed state. As the result, by the operation of the first operation valve 65A1, the first counter pressure against the first operation pressure can be applied to the second hydraulic receiving portion 53*b* of the traveling pump 53L.

In addition, in the case where the first operation pressure is applied to the first hydraulic receiving portion 53*a* of the traveling pump 53R by the operation of the second operation member 58, the second operation valve 65A2 changes the opening aperture from the fully closed state. As the result, the first counter pressure against the first operation pressure can be applied to the second hydraulic receiving portion 53*b* of the traveling pump 53R by the operation of the second operation valve 65A2.

Second Embodiment

Figure 4:
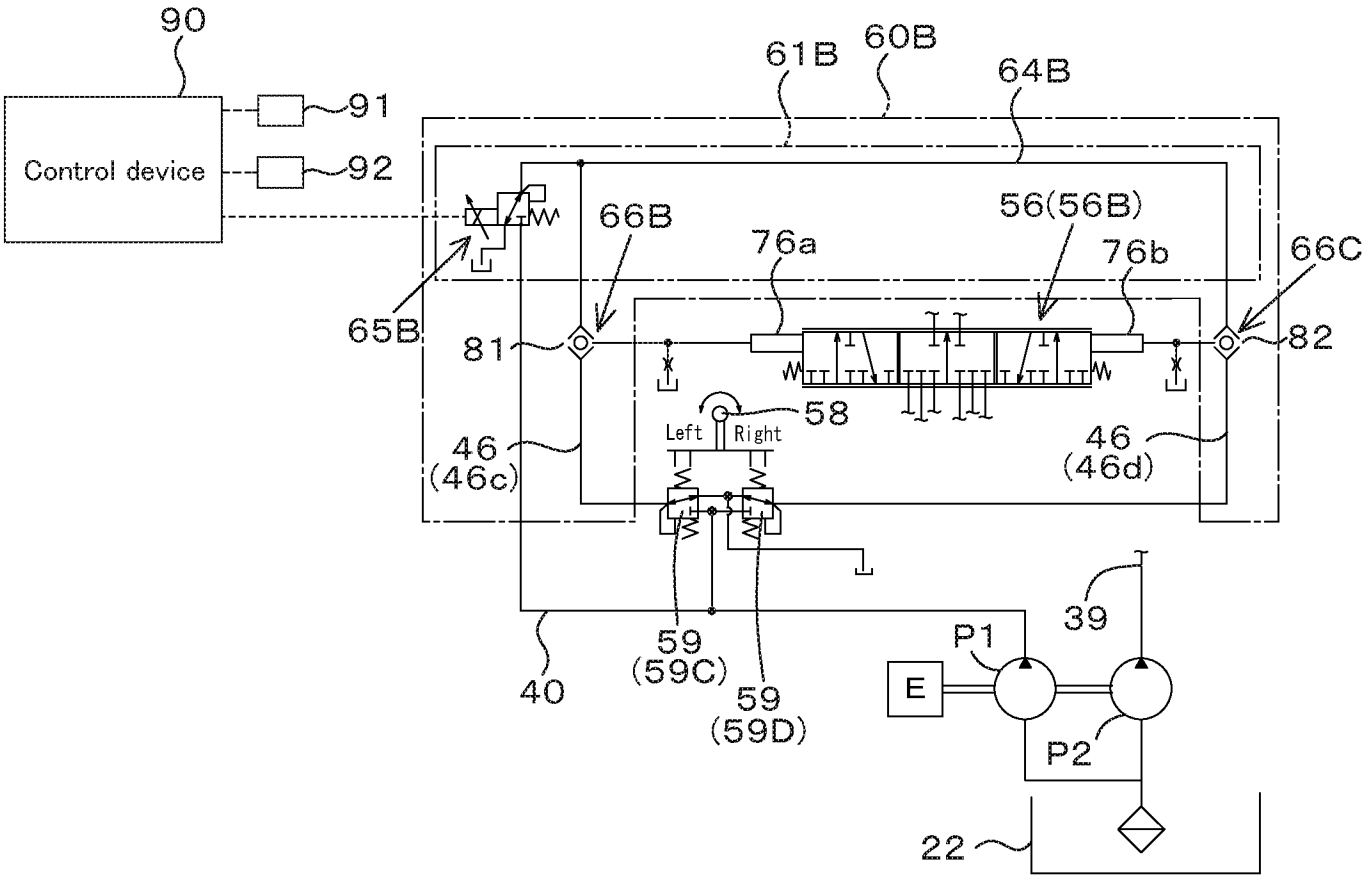
FIG. 4 is a schematic view of a hydraulic system of a working system according to a second embodiment of the present invention.
Figure 5:
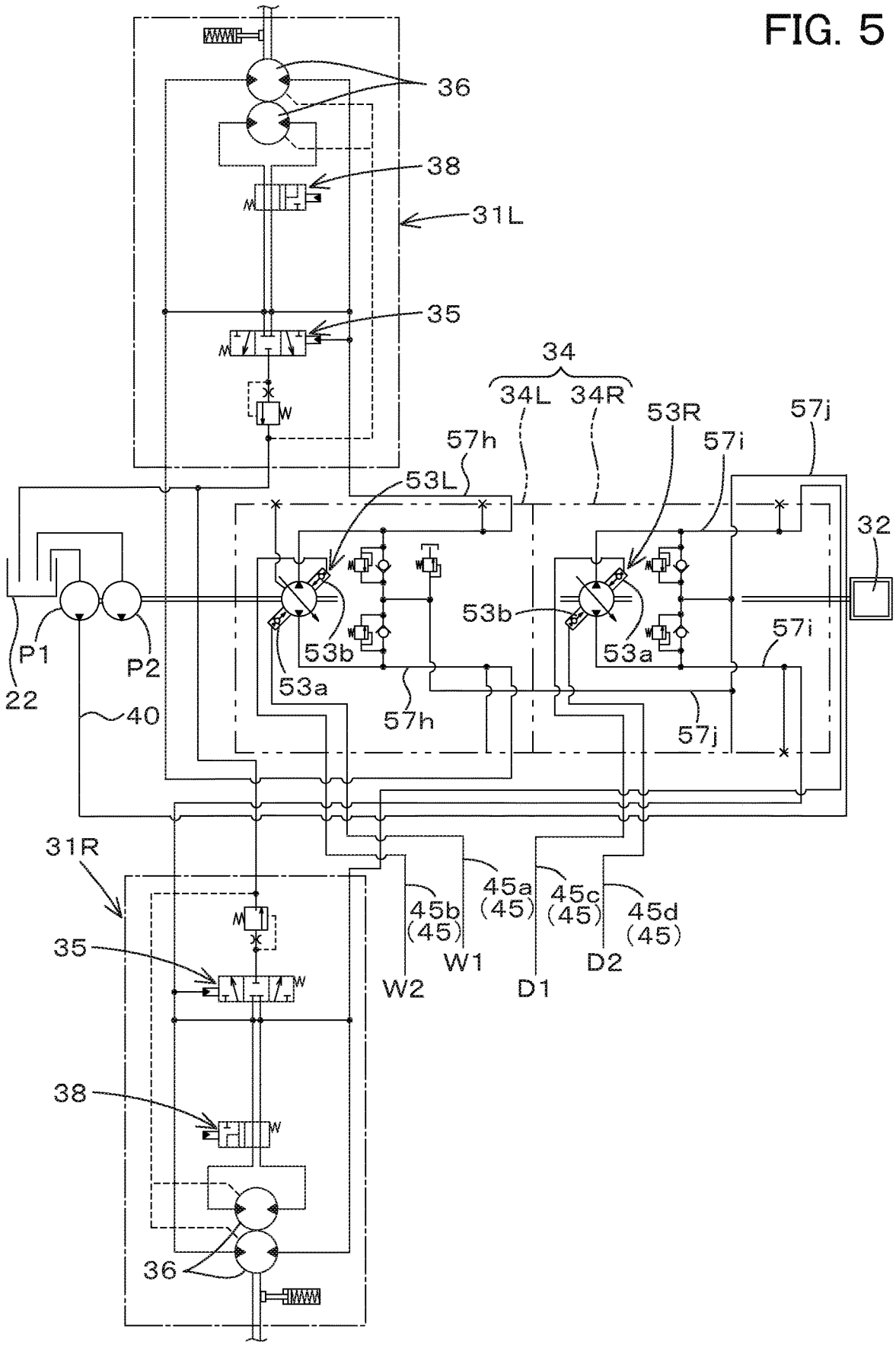
FIG. 5 is a schematic view of a hydraulic system of a traveling system according to a third embodiment of the present invention.
Figure 6:
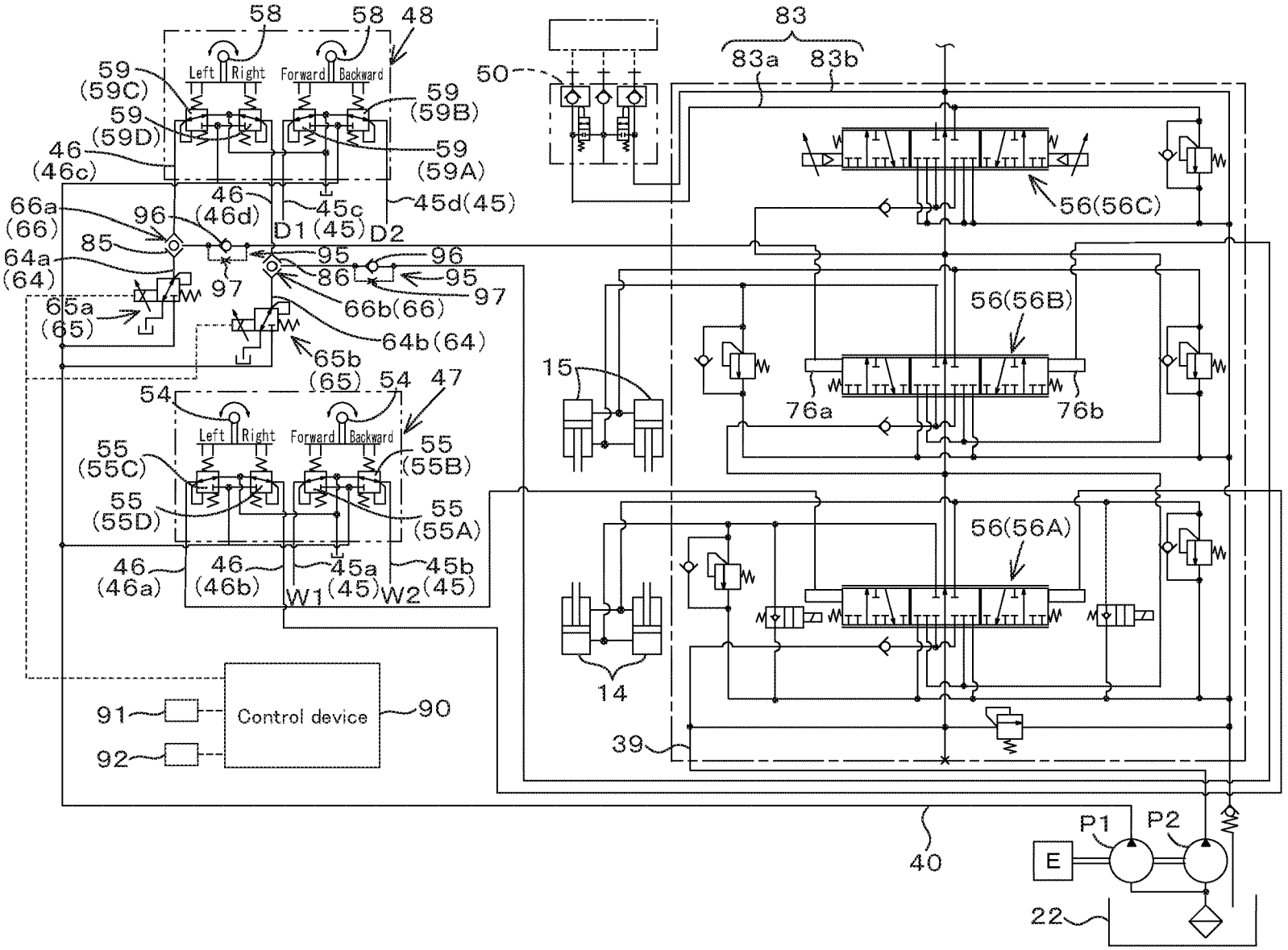
FIG. 6 is a schematic view of a hydraulic system of a working system according to the third embodiment.
Figure 7:
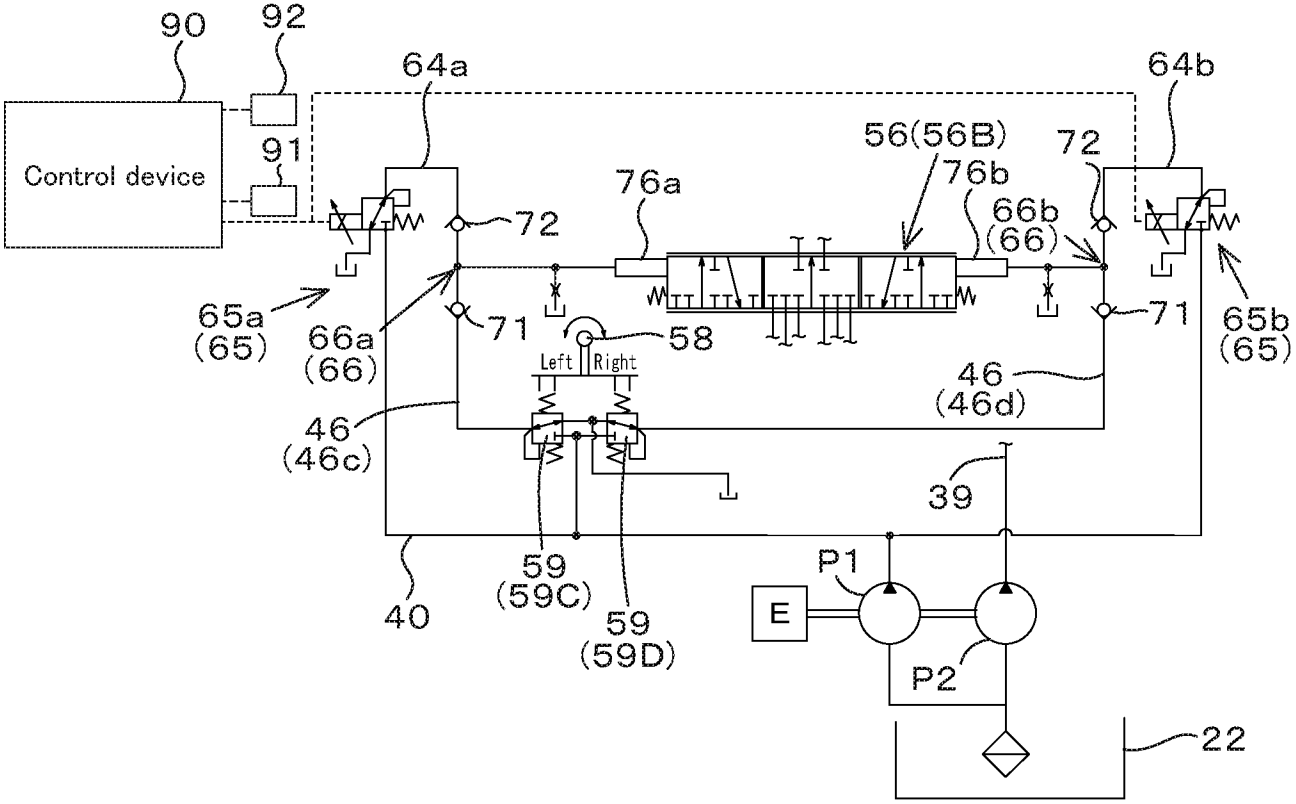
FIG. 7 is a schematic view illustrating a first modified example of the hydraulic system of the traveling system according to the third embodiment.

FIG. 4 shows a hydraulic system according to a second embodiment of the present invention. The same reference numerals are given to the same configurations as those of the first embodiment, and description thereof is omitted. The hydraulic system according to the second embodiment is a system configured to supply another pilot pressure against the pilot pressure received by the hydraulic device for working, for example, received by the second control valve 56B. It should be noted that the second control valve 56 is an example of a hydraulic device for working, but it is not limited to the hydraulic device for working.

The second control valve 56B has a first hydraulic receiving portion 76*a* and a second hydraulic receiving portion 76*b*. A third work fluid tube (a first supply fluid tube) 46*c* is connected to the first hydraulic receiving portion 76*a*. The fourth operation fluid tube (a second supply fluid tube) 46*d* is connected to the second hydraulic receiving portion 76*b*.

That is, the second control valve 56B is controlled to be switched between a neutral position, a first position different from the neutral position, and a second position different from the neutral position and the first position by the pilot pressure of the operation fluid supplied to the first hydraulic receiving portion 76*a* and the second hydraulic receiving portion 76*b*.

For convenience of the explanation, an operation valve configured to apply the pressure of the operation fluid to the first hydraulic receiving portion 76*a* of the second control valve 56, that is, the pilot valve 59C may be referred to as "a first operation valve". In addition, the operation valve configured to apply the pressure of the operation fluid to the second hydraulic receiving portion 76*b* of the second control valve 56, that is, the pilot valve 59D may be referred to as "a second operation valve".

The pressure supplying device 60B includes a first supply fluid tube and a second supply fluid tube. The first supply fluid tube is a fluid tube connecting the first operation valve 59C and the first hydraulic receiving portion 76*a* to each other. The second supply fluid tube is a fluid tube connecting the second operation valve 59D and the second hydraulic receiving portion 76*b* to each other. The first supply fluid tube is the third operation fluid tube 46*c*. The second supply fluid tube is the fourth operation fluid tube 46*d*.

The pressure supply portion 60B includes a branched fluid tube 64B and an operation valve 65B. The branched fluid tube 64B is a fluid tube connecting the hydraulic pump P1 to the third operation fluid tube 46*c* and the fourth operation fluid tube 46*d*. The branched fluid tube 64B is connected to the hydraulic pump P1, and is confluent with (connected to) the operation fluid tube. The branched fluid tube 64B is provided with an operation valve 65B.

The operation valve 65B is an electromagnetic proportional valve (a solenoid proportional valve) 65B configured to change the opening aperture thereof by magnetizing the solenoid.

The hydraulic system for the working machine 1 includes a first high pressure selection valve (a first shuttle valve) 81 and a second high pressure selection valve (a second shuttle valve) 82.

The first shuttle valve 81 is provided in the first confluent portion 66B where the third operation fluid tube 46*c* and the branched fluid tube 64B are confluent with (connected to) each other. In the case where the pressure of the operation fluid supplied from the first operation valve 59C is larger than the pressure of the operation fluid supplied from the operation valve 65B, the first shuttle valve 81 supplies the operation fluid to the first hydraulic receiving portion 76*a*, the operation fluid being supplied from the first operation valve 59C.

On the other hand, in the case where the pressure of the operation fluid supplied from the operation valve 65B is larger than the pressure of the operation fluid supplied from the first operation valve 59C, the operation fluid supplied from the operation valve 65B is supplied to the first hydraulic receiving portion 76*a*.

The second shuttle valve 82 is provided in the second confluent portion 66C where the fourth operation fluid tube 46*d* and the branched fluid tube 64B are confluent with (connected to) each other. In the case where the pressure of the operation fluid supplied from the second operation valve 59D is larger than the pressure of the operation fluid supplied from the operation valve 65B, the second shuttle valve 82 supplies the operation fluid to the second hydraulic receiving portion 76*b*, the operation fluid being supplied from the second operation valve 59D.

On the other hand, in the case where the pressure of the operation fluid supplied from the operation valve 65B is larger than the pressure of the operation fluid supplied from the second operation valve 59D, the operation fluid supplied from the operation valve 65B is supplied to the second hydraulic receiving portion 76*b*.

As described above, when the second operation member 58 is tilted leftward (to the left side), the first operation valve 59C is operated so that the first operation pressure is applied to the first hydraulic receiving portion 76*a* by the first operation valve 59C. In that case, the operation valve 65B changes the opening aperture thereof from the fully closed state.

As the result, the first counter pressure against the first operation pressure is applied to the second hydraulic receiving portion 76*b* of the second control valve 56B by the operation of the operation valve 65B.

On the other hand, when the second operation member 58 is tilted rightward (to the right side), the second operation valve 59D is operated, and thereby the second operation pressure is applied to the second hydraulic receiving portion 76*b* by the second operation valve 59D. In that case, the operation valve 65B changes the opening aperture thereof from the fully closed state.

As the result, the second counter pressure against the second operation pressure can be applied to the first hydraulic receiving portion 76*a* of the second control valve 56B by the operation of the operation valve 65B.

Meanwhile, it is preferable that the control device 90 controls the operation valve 65B. As described above, in the case where the second operation member 58 is tilted leftward (to the left side), the control device 90 sets the pressure set by the operation valve 65B as the pressure set by the first operation valve 59C.

In addition, also in the case where the second operation member 58 is tilted rightward (to the right side), the control device 90 sets the pressure set by the operation valve 65B as the pressure set by the second operation valve 59D.

Thus, in the second embodiment, the pilot pressure (the first counter pressure and the second counter pressure) applied from the operation valve 65B is applied to the first hydraulic receiving portion 76*a* and the second hydraulic receiving portion 76*b* of the second control valve 59B. Thus, it is possible to lower the output of the second control valve 56B. It is possible to sufficiently secure the HST charge flow rate and the operation fluid to be supplied to the other second control valve 56B.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modified examples within and equivalent to a scope of the claims.

Hereinafter, a further preferred embodiment of the hydraulic system of the working machine 1 according to the present invention will be described with reference to the drawings as appropriate.

Third Embodiment

Embodiments of the present invention will be described below with reference to the drawings.

FIG. 10 shows a side view of the working machine according to the embodiments of the present invention. FIG. 10 shows a compact track loader as an example of the working machine.

However, the working machine according to the present invention is not limited to a compact track loader, and may be another type of loader working machine such as a skid steer loader, for example. In addition, the working machine according to the present invention may be a working machine other than the loader working machine.

As shown in FIG. 10 and FIG. 11, the working machine 1 includes a machine body 2, a cabin 3, a working device 4, and a traveling device 5.

In the embodiment of the present invention, the front side (the left side in FIG. 10) of an operator seated on the operator seat 8 of the working machine 1 is referred to as the front. The rear side (the right side in FIG. 10) of the operator is referred to as the right. The left side (the front surface side of FIG. 10) of the operator is referred to as the left. The right side (the back surface side of FIG. 10) of the operator is referred to as the right.

In addition, the horizontal direction which is orthogonal to a direction toward the front direction or a direction toward the rear direction will be described as a machine width direction. A direction from the center portion of the machine body 2 to the right portion or to the left portion will be described as a machine outward direction.

In other words, the machine outward direction is equivalent to the machine width direction, and is a direction separating away from the machine body 2. In the explanation of the embodiment, a direction opposite to the machine outward direction is referred to as the machine inward direction. In other words, the machine inward direction is equivalent to the machine width direction, and is a direction approaching the machine body 2.

The cabin 3 is mounted on the machine body 2. The cabin 3 is provided with the operator seat 8. The working device 4 is attached on the machine body 2. The traveling device 5 is provided outside the machine body 2. A prime mover 32 is mounted on the rear portion of the machine body 2.

The working device 4 includes a boom 10, a working tool 11, a lift link 12, a control link 13, a boom cylinder 14, and a bucket cylinder 15.

The boom 10 is provided on the right side of the cabin 3, and is configured to be swung vertically. Another boom 10 is provided on the left side of the cabin 3, and is configured to be swung vertically. The working tool 11 is, for example, a bucket, and the bucket 11 is provided at a tip end portion (a front end portion) of the boom 10, and is configured to be swung vertically.

The lift link 12 and the control link 13 support the base portion (the rear portion) of the boom 10. By the lift link 12 and the control link 13, the boom 10 can be swing upward and downward.

The boom cylinder 14 is stretched and shortened to move the boom 10 upward and downward. The bucket cylinder 15 is stretched and shortened to swing the bucket 11.

A front portion of the boom 10 arranged on the left side is connected to a front portion of the boom 10 arranged on the right side by a deformed connecting pipe. The base portions (the rear portions) of the booms 10 are connected to each other by a circular connecting pipe.

The lift link 12, the control link 13 and the boom cylinder 14 are provided on the left side of the machine body 2, corresponding to the booms 10 arranged on the left. Another lift link 12, another other control link 13 and another boom cylinder 14 are provided on the right side of the machine body 2, corresponding to the booms 10 arranged on the right.

The lift link 12 is provided at the rear portion of the base portion of the boom 10 in the vertical direction. The upper portion (one end side) of the lift link 12 is pivotally supported by a pivot shaft (a first pivot shaft) 16 near the rear portion of the base portion of the boom 10, and is configured to freely turn about a lateral axis.

In addition, the lower portion (the other end side) of the lift link 12 is pivotally supported by a pivot shaft (a second pivot shaft) 17 near the rear portion of the machine body 2, and is configured to freely turn about the lateral axis. The second pivot shaft 17 is provided below the first pivot shaft 16.

The upper portion of the boom cylinder 14 is pivotally supported by a pivot shaft (a third pivot shaft) 18 so as to be rotatable around the lateral axis. The third pivot shaft 18 is the base portion of the boom 10, and is provided at the front portion of the base portion.

The lower portion of the boom cylinder 14 is pivotally supported by a pivot shaft (a fourth pivot shaft) 19 so as to be rotatable around the lateral axis. The fourth pivot shaft 19 is provided on a portion close to a lower portion of the rear portion of the machine body 2 and below the third pivot shaft 18.

The control link 13 is provided in front of the lift link 12. One end of the control link 13 is pivotally supported by a pivot shaft (a fifth pivot shaft) 20 so as to be rotatable around the lateral axis. The fifth pivot shaft 20 is the machine body 2, and is provided at a position corresponding to the front of the lift link 12.

The other end of the control link 13 is pivotally supported by a pivot shaft (a sixth pivot shaft) 21 so as to be rotatable around the lateral axis. The sixth pivot shaft 21 is provided in front of the second pivot shaft 17 and above the second pivot shaft 17 in the boom 10.

As described above, the base portion of the boom 10 is supported by the lift link 12 and the control link 13. When the boom cylinder 14 is stretched or shortened, the boom 10 swings upward and downward around the first pivot shaft 16. In this manner, the tip end portion of the booms 10 moves up and down.

The control link 13 swings upward and downward about the fifth pivot shaft 20 in synchronization with the upward and downward swinging of the boom 10. The lift link 12 swings backward and forward around the second pivot shaft 17 in synchronization with the upward and downward swinging of the control link 13.

Instead of the bucket 11, another working tool can be attached to the front portion of the boom 10. The other working tool is, for example, an attachment (an auxiliary attachment) such as a hydraulic crusher, a hydraulic breaker, an angle bloom, an earth auger, a pallet fork, a sweeper, a mower, a snow blower or the like.

A connecting member 50 is provided at the front portion of the boom 10 arranged on the left. The connecting member 50 is a device configured to connect the hydraulic device provided in the auxiliary attachment to the first piping material such as a pipe provided on the boom 10.

In particular, the first piping member can be connected to one end of the connecting member 50, and the second piping member connected to the hydraulic device of the auxiliary attachment can be connected to the other end of the connecting member 50. In this manner, the operation fluid flowing through the first piping member passes through the second piping member, and then is supplied to the hydraulic device.

The bucket cylinder 15 is arranged at a portion close to the front portion of the boom 10. The bucket 11 is swung due to the stretching and shortening of the bucket cylinder 15.

In the embodiment, the traveling device 5 arranged on the left employs a traveling, device of a crawler type (including a semi-crawler type), and the traveling device 5 arranged on the right also employs the traveling device of a crawler type (including the semi-crawler type). Note that a traveling device of a wheel type having a front wheel and a rear wheel may be employed.

Next, a hydraulic system of a traveling system will be described.

Figure 9:
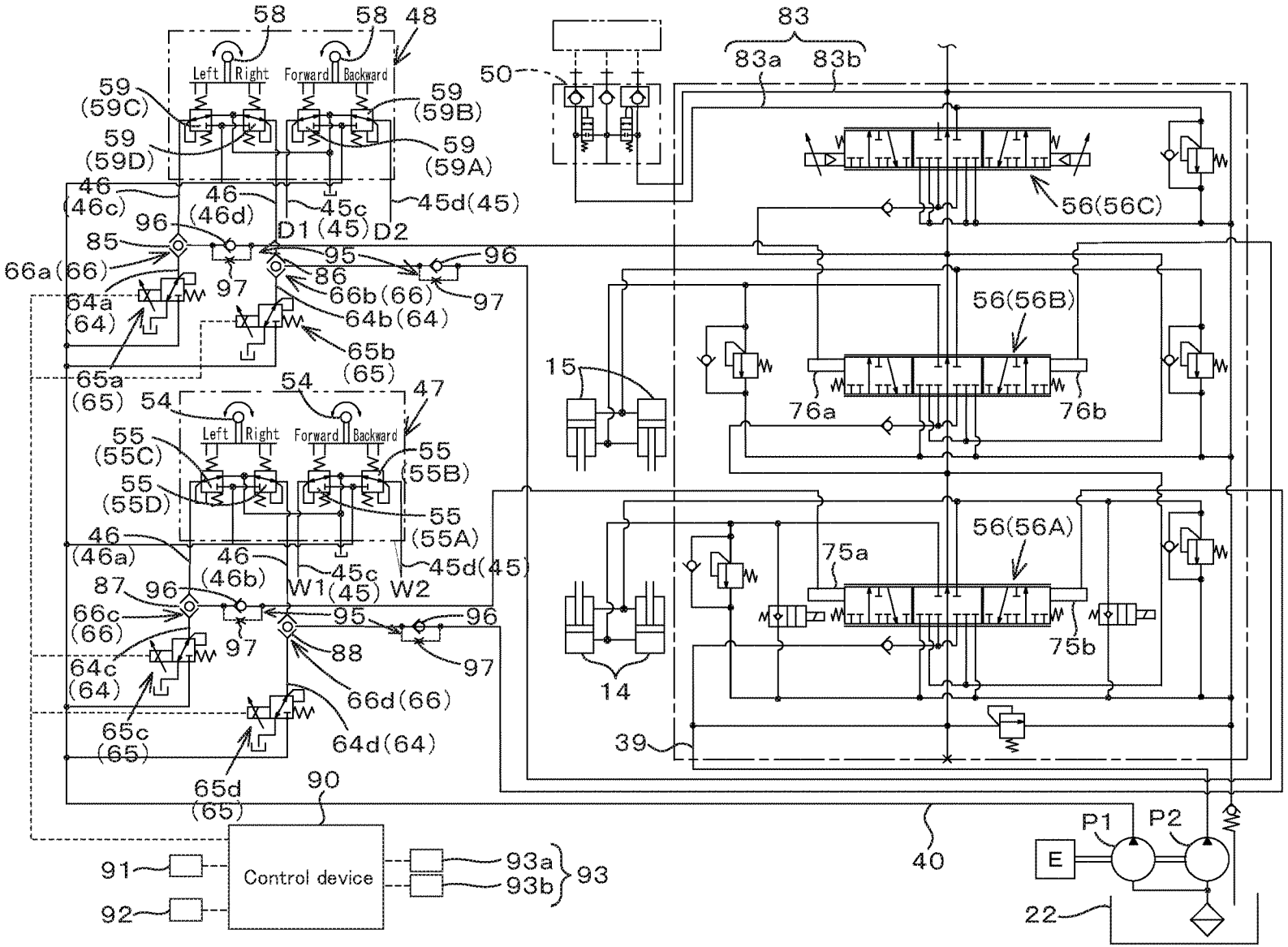
FIG. 9 is a schematic view of a hydraulic system of a working system according to a fourth embodiment of the present invention.

As shown in FIG. 9, the hydraulic system includes a first hydraulic pump P1, a left traveling motor device (a first traveling motor device) 31L, a right traveling motor device (a second traveling motor device) 31R, the prime mover 32, and a traveling driving device 34.

The first hydraulic pump P1 is constituted of a pump driven by a motive power of the prime mover 32, and is constituted of a constant displacement type gear pump. The first hydraulic pump P1 is configured to output the operation fluid stored in the tank 22.

The first hydraulic pump P1 outputs the operation fluid that is mainly used for control. For convenience of the explanation, the tank 22 for storing the operation fluid may be referred to as an operation fluid tank. In addition, among the operation fluid outputted from the first hydraulic pump P1, the operation fluid used for the control may be referred to as a pilot fluid, and a pressure of the pilot fluid may be referred to as a pilot pressure.

A fluid tube (an outputting fluid tube) 40 through which the operation fluid (the pilot fluid) flows is provided on the outputting side of the first hydraulic pump P1. The first traveling motor device 31L and the second traveling motor device 31R are provided in the outputting fluid tube (the first fluid tube) 40.

The prime mover 32 is constituted of an electric motor, an engine, and the like. In the embodiment, the prime mover 32 is an engine. It should be noted that the prime mover 32 may have a configuration of a hybrid type including the electric motor and the engine, or may have a configuration including only the electric motor.

The traveling driving device 34 is a device configured to drive the first traveling motor device 31L and the second traveling motor device 31R. The traveling driving device 34 includes a drive circuit (a left drive circuit) 34L for driving the first traveling motor device 31L and a drive circuit (a right drive circuit) 34R for driving the second traveling motor device 31R.

Each of the left driving circuit 34L and the right driving circuit 34R includes the traveling pumps (the traveling hydraulic pumps) 53L and 53R, the transmission fluid tubes 57*h* and 57*i*, and the second charging fluid tube 57*j*.

The transmission fluid tubes 57*h* and 57*i* are fluid tubes connecting the traveling pumps 53L and 53R and the traveling motor 36 to each other. The second charge fluid tube 57*j* is a fluid tube connected to the transmission fluid tubes 57*h* and 57*i*, and supplies the operation fluid outputted from the first hydraulic pump P1 to the transmission fluid tubes 57*h* and 57*i*.

Each of the traveling pumps 53L and 53R is constituted of a variable displacement axial pump of swash-plate type, the variable displacement axial pump being configured to be driven by the motive power of the prime mover 32. In other words, the traveling pumps 53L and 53R are traveling actuators configured to be operated by the operation fluid.

Each of the traveling pumps 53L and 53R includes a forward-traveling hydraulic receiving portion 53*a* and a backward-traveling hydraulic receiving portion 53*b* on which the pilot pressure is applied. The angles of the swash plates of the traveling pumps 53L and 53R are changed by the pilot pressures applied to the forward-traveling hydraulic receiving portion 53*a* and the reverse traveling hydraulic receiving portion 53*b*. By changing the angle of the swash plate, it is possible to change the outputs (an output amount of the operation fluid) of the traveling pumps 53L and 53R and to change the output direction of the operation fluid.

The first traveling motor device 31L is constituted of a motor configured to transmit a power to the drive shaft of the traveling device 5 arranged on the left side of the machine body 2. The second traveling motor device 31R is constituted of a motor configured to transmit a power to the drive shaft of the travel device 5 arranged on the right side of the machine body 2.

The first traveling motor device 31L includes a traveling motor 36, a forward/backward direction switching valve 35, and a travel control valve (a hydraulic switching valve) 38. The operation fluid can be supplied to the traveling motor 36, the forward/backward direction switching valve 35, and the travel control valve 38.

The traveling motor 36 is constituted of a cam motor (a radial piston motor).

The traveling motor 36 changes the rotation and torque of the output shaft by changing the displacement (the motor capacity) in the operation.

Next, the hydraulic system of the working system will be described.

As shown in FIG. 10, the hydraulic system includes a plurality of control valves 56 and a working system hydraulic pump (a second hydraulic pump) P2.

The second hydraulic pump P2 is constituted of a pump installed at a position different from that of the first hydraulic pump P1, and is constituted of a constant displacement type gear pump. The second hydraulic pump P2 is configured to output the operation fluid stored in the tank 22. The second hydraulic pump P2 outputs the operation fluid mainly used for operating the hydraulic actuator.

On the output side of the second hydraulic pump P2, a fluid tube (a main fluid tube) 39 is provided. A plurality of control valves 56 are connected to the main fluid tube 39. The control valves 56 are configured to switch the direction of flow of the operation fluid in accordance with the pilot pressure of the pilot fluid.

In addition, the control valve 56 controls (drives) a hydraulic device such as a boom, a bucket, a hydraulic crusher, a hydraulic breaker, an angle bloom, an earth auger, a pallet fork, a sweeper, a mower, a snow blower.

The plurality of control valves 56 include the first control valve 56A, the second control valve 56B, and the third control valve 56C. The first control valve 56A is a valve configured to control the hydraulic cylinder (the boom cylinder) 14 for controlling the boom. The second control valve 56B is a valve configured to control the hydraulic cylinder (the bucket cylinder) 15 for controlling the bucket.

The third control valve 56 C is a valve for controlling the hydraulic device (the hydraulic cylinder, the hydraulic motor) attached to the auxiliary attachment such as a hydraulic crusher, a hydraulic breaker, an angle bloom, an earth auger, a pallet fork, a sweeper, a mower, a snow blower.

In the following explanation, the first control valve 56A is referred to as a boom control valve. In addition, the second control valve 56B is referred to as a bucket control valve.

Each of the first control valve 56A and the second control valve 56B is constituted of a direct-acting spool type three-position selector valve using a pilot pressure. The first control valve 56A and the second control valve 56B are switched by the pilot pressure to the neutral position, to the first position different from the neutral position, and to the second position different from the neutral position and the first position.

The first control valve 56A can be operated by the pressure difference of the operation fluids applied to the hydraulic receiving portion on one side of the first control valve 56A and the hydraulic receiving portion on the other side of the first control valve 56A. In addition, the second control valve 56B can be operated by the pressure difference of the operation fluids applied to the hydraulic receiving portion on one side of the second control valve 56B and the hydraulic receiving portion on the other side of the second control valve 56B.

The boom cylinder 14 is connected to the first control valve 56A by a fluid tube, and the bucket cylinder 15 is connected to the second control valve 56B by a fluid tube.

A supply/output fluid tube 83 is connected to the third control valve 56C. One end of the supply/output fluid tube 83 is connected to the supply/output port of the third control valve 56C. An intermediate portion of the fluid supply/output fluid tube 83 is connected to the connecting member 50. The other end portion of the fluid supply/output fluid tube 83 is connected to the hydraulic device of the auxiliary attachment.

In particular, the supply/output fluid tube 83 includes a first supply/output fluid tube 83*a* that connects the first supply/output port of the third control valve 56C to the first port of the connecting member 50. In addition, the supply/output fluid tube 83 includes a second supply/output fluid tube 83*b* that connects the second supply/output port of the third control valve 56C to the second port of the connecting member 50.

In other words, by operating the third control valve 56C, the operation fluid can be supplied from the third control valve 56C toward the first supply/output fluid tube 83*a*. In addition, it is also possible to allow the operation fluid to flow from the third control valve 56C toward the second supply/output fluid tube 83*b*.

As shown in FIG. 9 and FIG. 10, the operation relating to traveling of the working machine 1 (the traveling operation) and the operation relating to the working (the working operation) are performed by the first operation device 47 provided on the left side of the operator seat 8 and the second operation device 48 provided on the right side of the operator seat 8.

In other words, the first operating device 47 and the second operating device 48 are operation devices for operating the hydraulic devices (the traveling motor 36, traveling pumps 53 L and 53 R) of the traveling system, the hydraulic devices of the working system (the first control valve 56A, the second control valve 56B, the third control valve 56C, the boom cylinder 14, the bucket cylinder 15, the hydraulic cylinder provided in the auxiliary attachment, and the hydraulic motor).

Next, the first operation device 47 and the second operation device 48 will be described in detail.

The first operating device 47 is a device configured to perform both of the traveling operation and the working operation, and includes a first operation member 54. The first operation member 54 is constituted of a lever, and is configured to perform the first operation for being moved in the forward direction or the backward direction and the second operation for being moved in the leftward direction or the rightward direction (in the machine width direction) different from the forward direction and the backward direction.

In other words, the first operation member 54 is constituted of a lever configured to be moved in one direction (for example, the forward, the leftward) and another direction (for example, the backward, the rightward) different from one direction.

In the first operation member 54, the first operation is assigned to the traveling operation, and the second operation is assigned to the working operation. That is, the first operation member 54 is used as an operation member for traveling (a traveling operation member) and as an operation member for working (a working member). The first operation member 54 is not limited to a lever as long as it can perform at least the first operation and the second operation independently.

A plurality of pilot valves 55 are provided in a lower portion of the first operation member 54. The plurality of pilot valves 55 can change a pressure of the operation fluid in accordance with operation of the first operation member 54. To explain specifically, the pilot valve 55 has a rod to be contacted to the first operation member 54.

That is, the pressure of the operation fluid outputted from the pilot valve 55 is changed by the rod pushed in accordance with the operation of the first operation member 54. The plurality of pilot valves 55 include the pilot valve 55A, the pilot valve 55B, the pilot valve 55C, and the pilot valve 55D. The pilot valve 55A, the pilot valve 55B, the pilot valve 55C, and the pilot valve 55D are connected to the outputting fluid tube 40.

The pilot valve 55A is a valve configured to be operated in a forward operation of the first operation (the forward operation and the backward operation), and changes the pressure of the operation fluid to be output in accordance with the operation extent (the operation) of the forward operation. The pilot valve 55B is a valve configured to be operated in a backward operation of the first operation (the forward operation and the backward operation), and changes the pressure of the operation fluid to be output in accordance with the operation extent (the operation) of the backward operation. That is, the pilot valve 55A and the pilot valve 55B are valves configured to be operated in the first operation, and move in accordance with the traveling operation.

The pilot valve 55C is a valve configured to be operated in a leftward operation of the second operation (the leftward operation and the rightward operation), and changes the pressure of the operation fluid to be output in accordance with the operation extent (the operation) of the leftward operation. The pilot valve 55D is a valve configured to be operated in a rightward operation of the second operation (the leftward operation and the rightward operation), and changes the pressure of the operation fluid to be output in accordance with the operation extent (the operation) of the rightward operation. That is, the pilot valve 55C and the pilot valve 55D are valves configured to be operated in the second operation, and move in accordance with the working operation.

The second operating device 48 is a device configured to perform both the traveling operation and the working operation, and has a second operation member 58. The second operation member 58 is constituted of a lever, and configured to perform a first operation for moving the lever backward and forward and a second operation for moving the lever leftward and rightward (in the machine width direction) different from the forward direction and the backward direction. In other words, the second operation member 58 is a lever configured to be moved in one direction (for example, the forward direction and the leftward direction) and in the other direction (for example, the backward direction and the rightward direction) different from the one direction.

In the second operation member 58, the first operation is assigned to the traveling operation, and the second operation is assigned to the working operation. That is, the second operation member 58 is used for an operation member for traveling (a traveling operation member), and is also used for an operation member for working (a working operation member). Meanwhile, the second operation member 58 may be constituted of any device as long as at least the first operation and the second operation can be performed independently. Thus, the second operation member 58 is not limited to the lever.

A plurality of pilot valves 59 are provided on a lower portion of the second operation member 58. The plurality of pilot valves 59 are configured to change the pressure of the operation fluid in accordance with the operation of the second operation member 58. To explain specifically, the pilot valve 59 has a rod to be contacted to the second operation member 58. That is, the pressure of the operation fluid outputted from the pilot valve 59 is changed by the rod pushed in accordance with the operation of the second operation member 58.

The plurality of pilot valves 59 include the pilot valve 59A, the pilot valve 59B, the pilot valve 59C, and the pilot valve 59D. The pilot valve 59A, the pilot valve 59B, the pilot valve 59C, and the pilot valve 59D are connected to the outputting fluid tube 40.

The pilot valve 59A is a valve configured to be operated in the forward operation of the second operations (the forward operation and the backward operation), and changes the pressure of the operation fluid to be outputted in accordance with the operation extent (the operation) of the forward operation. The pilot valve 59B is a valve configured to be operated in the backward operation of the first operation (the forward operation and the backward operation), and changes the pressure of the operation fluid to be outputted in accordance with the operation extent (the operation) of the backward operation. That is, the pilot valve 59A and the pilot valve 59B are valves configured to be operated in the first operation, and to move in accordance with the traveling operation.

The pilot valve 59C is a valve configured to be operated by the left operation of the first operation (the leftward operation and the rightward operation), and changes the pressure of the operation fluid to be outputted in accordance with the operation extent (the operation) of the leftward operation. The pilot valve 59D is a valve configured to be operated in the rightward operation of the second operation (the leftward operation and the rightward operation), and changes the pressure of the operation fluid to be outputted in accordance with the operation extent (the operation) of the rightward operation. That is, the pilot valve 59C and the pilot valve 59D are valves configured to be operated in the second operation, and move in accordance with the working operation.

As described above, among the plurality of pilot valves, the pilot valve 55A, the pilot valve 55B, the pilot valve 59A, and the pilot valve 59B are operated in accordance with the traveling operation. In addition, the pilot valve 55C, the pilot valve 55D, the pilot valve 59C, and the pilot valve 59D are operated in accordance with the working operation. For convenience of the explanation, the pilot valve 55A, the pilot valve 55B, the pilot valve 59A, and the pilot valve 59B may be referred to as a traveling pilot valve.

Among, the traveling pilot valves, the pilot valve 55A configured to be operated in one direction (for example, the forward direction) of the first operation member 54 is referred to as a "first pilot valve". The pilot valve 55B configured to be operated in the other direction (for example, the backward direction) of the first operation member 54 is referred to as a "second pilot valve". The pilot valve 59A configured to be operated in one direction (for example, the forward direction) of the second operation member 58 is referred to as a "third pilot valve". The pilot valve 59B configured to be operated in the other direction (for example, the backward direction) of the second operation member 58 is referred to as a "fourth pilot valve".

Next, the relation between the traveling pilot valve, the working pilot valve, and the hydraulic device will be described. Symbols "W1", "W2", "D1", and "D2" shown in FIG. 9 and FIG. 10 indicate connection destinations of the fluid tubes.

The traveling pilot valve is connected to the traveling pumps 53L and 53R that are one of the hydraulic devices for traveling (the traveling hydraulic devices) by the traveling fluid tube 45. The travel fluid tube 45 includes a first travel fluid tube 45*a*, a second travel fluid tube 45*b*, a third travel fluid tube 45*c*, and a fourth travel fluid tube 45*d*.

The first traveling fluid tube 45*a* is a fluid tube that connects the first pilot valve 55A and the forward-traveling hydraulic receiving portion 53*a* of the traveling pump 53L to each other.

The second travel fluid tube 45*b* is a fluid tube that connects the second pilot valve 55B and the backward-traveling hydraulic receiving portion 53*b* of the traveling pump 53L to each other.

The third travel fluid tube 45*c* is a fluid tube that connects the third pilot valve 59A and the forward-traveling hydraulic receiving portion 53*a* of the traveling pump 53R to each other.

The fourth travel fluid tube 45*d* is a fluid tube that connects the fourth pilot valve 59B and the backward-traveling hydraulic receiving portion 53*b* of the traveling pump 53R to each other.

When the first operation member 54 is tilted forward (to the front side), the first pilot valve 55A is operated, and thereby the pilot pressure is outputted from the first pilot valve 55A. The pilot pressure is applied to the forward-traveling hydraulic receiving portion 53*a* of the traveling pump 53L.

When the second operation member 58 is tilted forward (to the front side), the third pilot valve 59A is operated, and thereby the pilot pressure is outputted from the third pilot valve 59A. The pilot pressure is applied to the forward-traveling hydraulic receiving portion 53*a* of the traveling pump 53R.

When the first operation member 54 is tilted backward (to the rear side), the second pilot valve 55B is operated, and thereby the pilot pressure is outputted from the second pilot valve 55B. The pilot pressure is applied to the backward-traveling hydraulic receiving portion 53*b* of the traveling pump 53L.

When the second operation member 58 is tilted backward (to the rear side), the fourth pilot valve 59B is operated, and thereby the pilot pressure is outputted from the fourth pilot valve 59B. The pilot pressure is applied to the backward-traveling hydraulic receiving portion 53*b* of the traveling pump 53R.

Accordingly, when the first operation member 54 and the second operation member 58 are swung forward, the traveling motor (the HST motor) 36 revolves forward at a speed proportional to the swinging extent of the first operation member 54 and the second operation member 58. As the result, the working machine 1 travels straight forward.

When the first operation member 54 and the second operation member 58 are swung backward, the traveling motor 36 revolves backward at a speed proportional to the swinging extent of the first operation member 54 and the second operation member 58. As the result, the working machine 1 travels straight backward.

In addition, when one of the first operation member 54 and the second operation member 58 is swung forward (to the front side) and the other is swung backward (to the rear side), the traveling motor 36 arranged on the right and the traveling motor 36 arranged on the right rotate in directions different from each other. As the result, the working machine 1 turns to the right or to the left.

As described above, traveling operation can be performed by moving the first operation member 54 backward and forward and moving the second operation member 58 backward and forward, so that it is possible to move the working machine 1 forward, backward, rightward, and leftward.

In addition, the working pilot valve is connected, by a operation fluid tube 46, to the control valve 56 that is one of the hydraulic devices for working (the working hydraulic device). The operation fluid tube 46 includes a first operation fluid tube 46*a*, a second operation fluid tube 46*b*, a third operation fluid tube 46*c*, and a fourth operation fluid tube 46*d*.

The first operation fluid tube 46*a* is a fluid tube that connects the pilot valve 55C to the hydraulic receiving portion of the first control valve 56A. The second operation fluid tube 46*b* is a fluid tube that connects the pilot valve 55D to the hydraulic receiving portion of the first control valve 56A.

The third operation fluid tube 46*c* is a fluid tube that connects the pilot valve 59C to the hydraulic receiving portion of the second control valve 56B. The fourth operation fluid tube 46*d* is a fluid tube that connects the pilot valve 59D to the hydraulic receiving portion of the second control valve 56B.

When the first operation member 54 is tilted leftward (to the left side), the pilot valve 55C is operated to set the pilot pressure of the pilot fluid outputted from the pilot valve 55C. This pilot pressure is applied to the hydraulic receiving portion of the first control valve 56A to stretch the boom cylinder 14. In this manner, the boom 10 is moved upward.

When the first operation member 54 is tilted rightward (to the right side), the pilot valve 55D is operated to set the pilot pressure of the pilot fluid outputted from the pilot valve 55D. The pilot pressure is applied to the hydraulic receiving portion of the first control valve 56A to shorten the boom cylinder 14. In this manner, the boom 10 moves downward.

When the second operation member 58 is tilted leftward (to the left side), the pilot valve 59C is operated to set the pilot pressure of the pilot fluid outputted from the pilot valve 59C. The pilot pressure is applied to the hydraulic receiving portion of the second control valve 56B to shorten the bucket cylinder 15. In this manner, the bucket 11 moves in the shoveling operation.

When the second operation member 58 is tilted rightward (to the right side), the pilot valve 59D is operated to set the pilot pressure of the pilot fluid outputted from the pilot valve 59D. The pilot pressure is applied to the hydraulic receiving portion of the second control valve 56B to stretch the bucket cylinder 15. In this manner, the bucket 11 moves in the dumping operation.

In this manner, when the first operation member 54 is moved leftward and rightward and the second operation member 58 is moved leftward and rightward, it is possible to perform work operations such as the upward and downward moving of the boom 10, the dumping operation of the bucket, or the shoveling operation of the bucket.

The hydraulic system includes a hydraulic pump, a first hydraulic device, a second hydraulic device, an operation member, and an operation valve. In the present embodiment, the hydraulic pump is the first hydraulic pump P1. The first hydraulic device is the second control valve 56B. The second hydraulic device is the first control valve 56A. The operation member is the second operation member 58. The operation valves include the pilot valves 59C and 59D. In addition, the hydraulic system has a supplying fluid tube.

In the present embodiment, the supplying fluid tube includes a third operation fluid tube 46*c* connecting the pilot valve 59C to the second control valve 56B, and a fourth operation fluid tube 46*d* connecting the pilot valve 59D to the second control valve 56B. The second control valve 56B includes a first hydraulic receiving portion 76*a* and a second hydraulic receiving portion 76*b*. In addition, the second control valve 56B is configured to be operated by a pressure difference between the operation fluids applied to the first hydraulic receiving portion 76*a* and the second hydraulic receiving portion 76*b*.

In particular, the third operation fluid tube 46*c* is connected to the first hydraulic receiving portion 76*a*. The fourth operation fluid tube 46*d* is connected to the first hydraulic receiving portion 76*b*. That is, the second control valve 56B is configured to be switched between a neutral position, a first position different from the neutral position, and a second position different from the neutral position and the first position by the pressure difference between the pilot pressures of the operation fluids applied to the first hydraulic receiving portion 76*a* and the second hydraulic receiving portion 76*b*.

The hydraulic system includes a branched fluid tube 64 and a solenoid valve 65. The branched fluid tube 64 includes a first branched fluid tube 64*a* confluent with (connected to) the third operation fluid tube 46*c* and a second branched fluid tube 64*b* confluent with (connected to) the fourth operation fluid tube 46*d*.

The solenoid valve 65 is constituted of an electromagnetic proportional valve (the proportional valve), and thereby changes the opening aperture thereof by magnetizing the solenoid. That is, the solenoid valve 65 is configured to change the flow rate of the operation fluid passing through the solenoid valve 65. The solenoid valve 65 includes a first electromagnetic valve 65*a* connected to the first branched fluid tube 64*a* and a second electromagnetic valve 65*b* connected to the second branched fluid tube 64*b*. The solenoid valve 65 connects the inlet side thereof to the first hydraulic pump P1, and connects the outlet side thereof to the branched fluid tube 64.

To explain specifically, the first solenoid valve 65*a* connects the outlet side thereof to the first branched fluid tube 64. The second electromagnetic valve 65*b* connects the outlet side thereof to the second branched fluid path 64*b*. When the opening aperture of the solenoid valve 65 is changed from the fully closed state, the operation fluid tubes 46*c* and 46*d* are connected to the first hydraulic pump P1. That is, the operation fluid can be applied from the hydraulic pump P1 to the second control valve 56B through the solenoid valve 65.

In particular, the operation fluid outputted by the first hydraulic pump P1 can be introduced into the operation fluid tubes 46*c* and 46*d* through the solenoid valve 65 and the branched fluid tube 64. In this manner, the operation fluid outputted from the hydraulic pump P1 can be applied to the second control valve 56B.

The hydraulic system is provided with a changing portion 51. The changing portion 51 is configured to change the state of the hydraulic system between a first state in which one of the pilot valves 59C and 59D and the solenoid valve 65 is operated and a second state in which both of the pilot valves 59C and 59D and the solenoid valve 65 are operated. The changing portion 51 has shuttle valves 85 and 86.

The shuttle valve 85 is provided at a confluent portion 66 of the operation fluid tube 46 and the branched fluid tube 64. The shuttle valve 86 is provided in a second confluent portion 66*b* where the fourth operation fluid tube 46*d* and the second branched fluid tube 64*b* are confluent with each other.

When either the pilot valve 59C or the solenoid valve 65 is operated (in the first state), the shuttle valve 85 transmits, to the first hydraulic receiving portion 76*a*, the pressure of the operation fluid set by the pilot valve 59C or the solenoid valve 65 actually operated.

When either the pilot valve 59D or the solenoid valve 65 is operated (in the first state), the shuttle valve 86 transmits, to the second hydraulic receiving portion 76*b*, the pressure of the operation fluid set by the pilot valve 59D or the solenoid valve 65 actually operated.

In addition, when both of the pilot valve 59D and the solenoid valve 65 are operated (in the second state), the shuttle valve 85 transmits, to the first hydraulic receiving portion 76*a*, the higher one of pressures of the operation fluids set by the pilot valve 59C or the solenoid valve 65 actually operated.

When both of the pilot valve 59D and the solenoid valve 65 are operated (in the second state), the shuttle valve 85 transmits, to the second hydraulic receiving portion 76*b*, the higher one of pressures of the operation fluids set by the pilot valve 59D or the solenoid valve 65 actually operated.

Thus, the changing portion 51in the first state applies the pressure of the operation fluid set by the operation valves 59C and 59D or the pressure of the operation fluid set by the solenoid valve 65 to the first hydraulic device such as the control valve 56. Thereby, it is possible to operate the first hydraulic device.

On the other hand, the changing portion 51 in the second state applies either the pressure of the operation fluid set by the operation valves 59C and 59D or the pressure of the operation fluid set by the solenoid valve 65 to the first hydraulic device such as the control valve 56. Thereby, it is possible to operate the first hydraulic device.

In addition, the changing portion 51 includes a control device 90. The control device 90 controls the solenoid valve 65. The control device 90 is constituted of a CPU and the like, and performs various processes relating to the devices connected to the control device 90. To describe the control device 90 in more detail, an angle detecting part 91 for detecting the angle of the boom 10 is connected to the control device 90. The control device 90 can be switched to the horizontal control mode (to the level control mode).

The horizontal control mode is a mode to keep the angle of the bucket 11 constant even if the operator does not operate the second operation member 58. Switching to the horizontal control mode is performed by the switch 92 connected to the control device 90. The switch 92 is a member instructing the control device 90 to be switched to the horizontal control mode. When the switch 92 is pressed, a signal instructing switching to the horizontal control mode is output to the control device 90.

On the other hand, when the switch 92 is pushed again, the horizontal control mode is canceled. The switch 92 is constituted of a push button switch 92 such as a momentary switch or an alternate switch. It should be noted that the switch 92 is not limited to the push button switch 92 such as the momentary switch or the alternate switch. The switch 92 may be configured of any switch as long as the switch 92 outputs a signal to the control device 90.

When the horizontal control mode is canceled, the operation fluid is applied from the pilot valves 59C and 59D to the second control valve 56B. In addition, the control device 90 closes the electromagnetic valve 65. On the other hand, when shifting to the horizontal control mode, the control device 90 controls the solenoid valve 65 to apply the operation fluid from the solenoid valve 65 to the second control valve 56B. In other words, one of the operation fluid of the pilot valves 59C and 59D and the operation fluid of the electromagnetic valve 65 is applied to the second control valve 56B that is the first hydraulic device.

In the horizontal control mode, the control device 90 operates the bucket 11 in accordance with the boom angle detected by the angle detecting part 91. In other words, the control device 90 controls the solenoid valve 65 in accordance with the movement of the first control valve 56A that is the second hydraulic device connected to the boom cylinder 14. For example, the control device 90 controls the bucket angle on the basis of the movement angle of the boom 10 from the transition to the horizontal control mode.

To explain specifically, when the boom cylinder 14 is shortened and the boom 10 moves downward, the control device 90 controls the solenoid valve 65 so that the bucket 11 performs the shoveling operation by the same value as the moving angle of the boom 10. On the other hand, when the boom cylinder 14 is stretched and the boom 10 moves upward, the control device 90 controls the solenoid valve 65 so that the bucket 11 performs the dumping operation by the same value as the moving angle of the boom 10.

That is, the bucket 11 is horizontally controlled. In particular, the control device 90 controls the solenoid valve 65 in accordance with the operation of the first control valve 56A. In this manner, the moving angle of the bucket 11 connected to the second control valve 56B can be controlled by the boom cylinder 14 in accordance with the moving angle of the boom 10 connected to the first control valve 56A.

Thus, since the above-described configuration is simple and detachable, the horizontal control function of the bucket 11 can be introduced into the hydraulic system of the working machine 1. Meanwhile, it is sufficient that the bucket 11 can be operated in accordance with the moving angle of the boom 10, and a detecting device configured to measure the stretched length and the shortened length of the boom cylinder 14 may be provided instead of the angle detecting part 91.

In addition, a pressure sensor may be provided in the operation fluid tube 46. The control device 90 may control the first solenoid valve 65*a* and the second solenoid valve 65*b* on the basis of the pressure of the operation fluid outputted from the operation valves 59C and 59D.

Meanwhile, the shuttle valves 85 and 86 include a first shuttle valve 85 and a second shuttle valve 86. The confluent portion 66 includes a first confluent portion 66*a* and a second confluent portion 66*b*.

The first shuttle valve 85 is provided in the first confluent portion 66*a* where the third operation fluid tube 46*c* and the first branched fluid tube 64*a* are confluent with (connected to) each other. The first shuttle valve 85 communicates the pilot valve 59C and the second control valve 56B with each other, and has a first position and a second position, the first position regulating the operation fluid of the first solenoid valve 65*a* and the operation fluid of the second control valve 56B, the second position regulating the operation fluid of the pilot valve 59C and the operation fluid of the second control valve 56B and to communicate the first solenoid valve 65*a* and the second control valve 56B with each other.

That is, in the case where the pressure of the operation fluid applied from the pilot valve 59C to the first shuttle valve 85 is larger than the pressure of the operation fluid applied from the first solenoid valve 65*a* to the first shuttle valve 85, the pressure of operation fluid set by the pilot valve 59C is applied to the first hydraulic receiving portion 76*a*. In that case, the operation fluid supplied from the first electromagnetic valve 65*a* to the first shuttle valve 85 does not apply a pressure to the first hydraulic receiving portion 76*a*.

On the other hand, in the case where the pressure of the operation fluid applied from the first solenoid valve 65*a* to the first shuttle valve 85 is larger than the pressure of the operation fluid applied from the pilot valve 59C to the first shuttle valve 85, the pressure of the operation fluid set by the first solenoid valve 65*a* is applied to the first hydraulic receiving portion 76*a*. In that case, the operation fluid applied from the pilot valve 59C to the first shuttle valve 85 is not applied to the first hydraulic receiving portion 76*a*.

The second shuttle valve 86 is provided in a second confluent portion 66*b* where the fourth operation fluid tube 46*d* and the second branched fluid tube 64*b* are confluent with (connected to) each other. The second shuttle valve 86 communicates the pilot valve 59D and the second control valve 56B with each other, and has a first position and a second position, the first position regulating the operation fluid of the second solenoid valve 65*b* and the operation fluid of the second control valve 56B, the second position regulating the operation fluid of the pilot valve 59D and the operation fluid of the second control valve 56B and to communicate the second solenoid valve 65*b* and the second control valve 56B with each other.

That is, in the case where the pressure of the operation fluid applied from the pilot valve 59D to the second shuttle valve 86 is larger than the pressure of the operation fluid applied from the second solenoid valve 65*b* to the second shuttle valve 86, the pressure of operation fluid set by the pilot valve 59D is applied to the second hydraulic receiving portion 76*b*. In that case, the operation fluid supplied from the second electromagnetic valve 65*b* to the second shuttle valve 86 does not apply a pressure to the second hydraulic receiving portion 76*b*.

On the other hand, in the case where the pressure of the operation fluid applied from the second solenoid valve 65*b* to the second shuttle valve 85 is larger than the pressure of the operation fluid applied from the pilot valve 59D to the second shuttle valve 86, the pressure of the operation fluid set by the second solenoid valve 65*b* is applied to the second hydraulic receiving portion 76*b*.

In that case, the operation fluid applied from the pilot valve 59D to the second shuttle valve 86 is not applied to the second hydraulic receiving portion 76*b*. In this manner, the operation fluid having a higher pressure of one of the operation fluid in the operation fluid tubes 46*c* and 46*d* and the operation fluid in the branched fluid tube 64 can be applied to the second control valve 56B.

On the other hand, it is possible to prevent the operation fluid having the lower pressure from being applied to the second control valve 56B, of the operation fluid in the operation fluid tubes 46*c* and 46*d* and the operation fluid in the branched fluid tube 64. Thus, it is possible to apply the operation fluid from one of the pilot valves 59C and 59D side and the solenoid valve 65 to the second control valve 56B.

A bypass check valve 96 is provided between the first hydraulic receiving portion 76*a* and the outlet side of the first shuttle valve 85 in the third operation fluid tube 46*c*, and another bypass check valve 96 is provided between the second hydraulic receiving portion 76*b* and the outlet side of the second shuttle valve 86 in the fourth operation fluid tube 46*d*. The bypass check valve 96 allows the operation fluid to flow from the pilot valves 59C and 59D to the second control valve 56B. Further, the bypass check valve 96 blocks the flow of operation fluid flowing from the second control valve 56B to the pilot valves 59C and 59D.

A bypass fluid tube 95 is provided on the inlet side and the outlet side of the bypass check valve 96. In the bypass fluid tube 95, a throttle 97 is provided. The throttle 97 reduces the flow rate of operation fluid. The throttle 97 is configured, for example, by making a part of the bypass fluid tube 95 narrower than the other parts.

In other words, the cross-sectional area of the portion through which the operation fluid flows in the bypass fluid tube 95 is made smaller than the other portion. It should be noted that the above configuration may be adopted to the hydraulic system of traveling.

FIG. 11 shows a first modified example of the third embodiment. The operation fluid tube 46 includes a first check valve 71 and a second check valve 72. The first check valve 71 is provided in the operation fluid tubes 46*c* and 46*d* between the pilot valves 59C and 59D and the confluent portion 66 of the operation fluid tubes 46*c* and 46*d* and the branched fluid tube 64.

That is, the first check valve 71 is provided in the third operation fluid tube 46*c*, and another first check valve 71 is provided in the fourth operation fluid tube 46*d*. To explain more specifically, the first check valve 71 allows the operation fluid to flow from the pilot valves 59C and 59D toward the confluent portion 66. Further, the first check valve 71 regulates the operation fluid flowing from the confluent portion 66 toward the pilot valves 59C and 59D.

On the other hand, the second check valve 72 is provided in a first branched fluid tube 64*a* connected to the third operation fluid tube 46*c*, and another second check valve 72 is provided in a second branched fluid tube 64*b* connected to the fourth operation fluid tube 46*d*. The second check valve 72 allows the operation fluid to flow from the electromagnetic valve 65 to the confluent portion 66. Further, the second check valve 72 regulates the flow of the operation fluid flowing from the confluent portion 66 toward the solenoid valve 65. In this manner, the operation fluid can be allowed to flow from the pilot valves 59C and 59D side toward the second control valve 56B side. It is also possible to prevent the operation fluid from flowing from the second control valve 56B and the solenoid valve 65 side toward the pilot valves 59C and 59D side.

In addition, the operation fluid can be allowed to flow from the electromagnetic valve 65 side toward the second control valve 56B side. Further, it is possible to prevent the operation fluid from flowing from the second control valve 56B and the pilot valves 59C and 59D side toward the solenoid valve 65 side. In this manner, it is possible to prevent the operation fluid from flowing back from the second control valve 56B and the solenoid valve 65 side to the pilot valves 59C and 59D. In addition, it is possible to prevent the operation fluid from flowing back from the second control valve 56B and the pilot valves 59C and 59D side to the solenoid valve 65.

Meanwhile, in the modified example described above, the second control valve 56B may be operated only by operating the second operation member 58. Further, the second control valve 56B may be operated only by the control of the control device 90. In addition, the second control valve 56B may be operated by both operations of the second operation member 58 and the control device 90.

Figure 8:
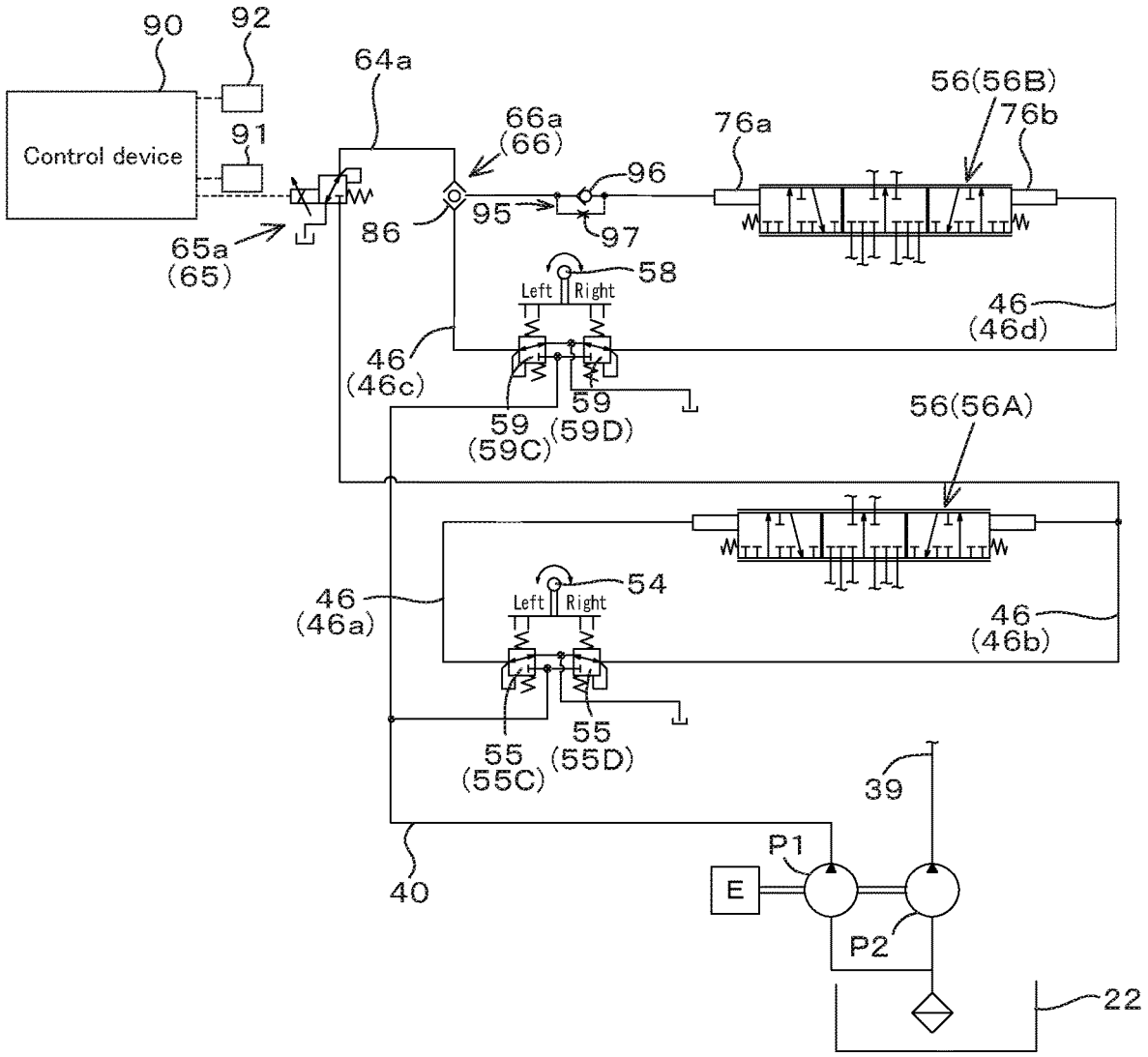
FIG. 8 is a schematic view illustrating a second modified example of the hydraulic system of the traveling system according to the third embodiment.

FIG. 8 shows a second modified example of the third embodiment. The first solenoid valve 65*a* connects the inlet side thereof to the second operation fluid tube 46*b*, and connects the outlet side thereof to the branched fluid tube 64*a*. In other words, in the horizontal control mode, when the control device 90 opens the first solenoid valve 65*a* from the closed state, the operation fluid outputted from the pilot valve 55D flows into the branched fluid tube 64*a* through the second operation fluid tube 46*b* and the first solenoid valve 65*a*.

The operation of the boom cylinder 14 and the bucket cylinder 15 in that case will be described in detail. When the operation fluid outputted from the pilot valve 55D is applied to the hydraulic receiving portion of the first control valve 56A, the boom cylinder 14 is shortened. As the result, the boom 10 moves downward. In addition, when the operation fluid outputted from the pilot valve 55D is applied to the first hydraulic receiving portion 76*a* of the second control valve 56B, the bucket cylinder 15 is shortened. As the result, the bucket 11 performs the shoveling operation.

That is, according to the above configuration, the control device 90 controls the opening aperture of the first solenoid valve 65*a*, whereby the shoveling operation of the bucket 11 can be controlled according to the downward movement of the boom 10. That is, the horizontal control of the bucket 11 can be performed.

The hydraulic system for the working machine 1 includes the hydraulic pump P1, the first hydraulic device 56B, the operation member 58, the operation valves 59C and 59D, the solenoid valve 65, the control device 90, and the changing portion 51. Thereby, it is possible to apply the operation fluid to the first hydraulic device 56B from two different paths of the operation valves 59C and 59D and the solenoid valve 65.

Thus, when the control device 90 opens the solenoid valve 65 to apply the operation fluid to the first hydraulic device 56B, it is possible to easily operate the first hydraulic device 56B separately from the operation of the operation member 58 by the operator.

In addition, the hydraulic system of the working machine 1 includes the second hydraulic device 56A. The control device 90 controls the solenoid valve 65 in accordance with the operation of the second hydraulic device 56A. In this manner, the control device 90 can control the operation angle of the hydraulic device 15 connected to the first hydraulic device 56B in accordance with the operation angle of the hydraulic device 14 connected to the second hydraulic device 56A.

Thus, the above-described configuration is simple and detachable. Thus, a horizontal control function can be introduced into the hydraulic system for the working machine 1.

In addition, the hydraulic system for the working machine 1 is provided with the supply fluid tubes 46*c* and 46*d* and the branched fluid tube 64. In this manner, the operation fluid is supplied to the first hydraulic device 56B from the two different fluid paths of the supply fluid tubes 46*c* and 46*d* to which the operation valves 59C and 59D are connected and the branched fluid tube 64 provided with the solenoid valve 65.

Thus, when the control device 90 opens the solenoid valve 65 to apply the operation fluid to the first hydraulic device 56B through the branched fluid tube 64, it is possible to easily operate the first hydraulic device 56B separately from the operation of the operation member 58 by the operator.

In addition, the changing portion 51 includes the shuttle valves 85 and 86. In this manner, of the operation fluid flowing through the supply fluid tubes 46*c* and 46*d* and the operation fluid flowing through the branched fluid tube 64, the operation fluid having a higher pressure can be applied to the first hydraulic device 56B. On the other hand, it is possible to block the flow of the operation fluid having a lower pressure out of the operation fluid in the supply fluid tubes 46*c* and 46*d* and the operation fluid in the branched fluid tube 64.

Thus, it is possible to apply the operation fluid to the first hydraulic device 56B from one of the operation valves 59C and 59D side and the solenoid valve 65.

In addition, the hydraulic system for the working machine 1 is provided with a first check valve 71 and a second check valve 72. Accordingly, it is possible to allow the operation fluid to flow from the side of the operation valves 59C and 59D side toward the first hydraulic device 56B side. It is also possible to prevent the operation fluid from flowing from the first hydraulic device 56B and the solenoid valve 65 side toward the operation valves 59C and 59D.

In addition, it is possible to allow the operation fluid to flow from the electromagnetic valve 65 side toward the first hydraulic device 56B side. It is also possible to prevent the operation fluid from flowing from the first hydraulic device 56B and the operation valves 59C and 59D side toward the solenoid valve 65 side.

Thus, it is possible to prevent the operation fluid from flowing back from the first hydraulic device 56B and the solenoid valve 65 side to the operation valves 59C and 59D. It is also possible to prevent the operation fluid from flowing back from the first hydraulic device 56B and the operation valves 59C and 59D side to the solenoid valve 65.

Further, the first hydraulic device 56B is the bucket control valve 56B. The second hydraulic device 56A is the boom control valve 56A. In this manner, the operating angle of the bucket 11 connected to the bucket control valve 56B can be controlled by the bucket cylinder 15 in accordance with the operating angle of the boom 10 connected to the boom control valve 56A.

Thus, the above-described configuration is simple and detachable. Thereby, the horizontal control function can be introduced to the hydraulic system for the working machine 1.

Fourth Embodiment

FIG. 9 shows a hydraulic system according to a fourth embodiment of the present invention. The same reference numerals are given to the same configurations as those of the third embodiment, and the description thereof will be omitted.

The hydraulic system includes a hydraulic pump, a first hydraulic device, an operation member, and an operation valve. In the present embodiment, the hydraulic pump is the first hydraulic pump P1. The first hydraulic device includes a first control valve 56A and a second control valve 56B. The operation member is the first operation member 54 and the second operation member 58. The operation valves are pilot valves 55C, 55D, 59C, and 59D.

In addition, the hydraulic system includes a supply fluid tube. In the present embodiment, the supply fluid tube includes an operation fluid tube 46*a* connecting the pilot valve 55C and the first control valve 56A to each other, a second operation fluid tube 46*b* connecting the pilot valve 55D and the first control valve 56A to each other, a third operation fluid tube 46*c* connecting the pilot valve 59C and the second control valve 56B to each other, and a fourth operation fluid tube 46*d* connecting the pilot valve 59D and the second control valve 56B to each other.

The first control valve 56A includes a first hydraulic receiving portion 75*a* and a second hydraulic receiving portion 75*b*. The first control valve 56A is configured to be operated by a pressure difference of the operation fluid applied to each of the first hydraulic receiving portion 75*a* and the second hydraulic receiving portion 75*b*. Concretely, the first operation fluid tube 46*a* is connected to the first hydraulic receiving portion 75*a*. The second operation fluid tube 46*b* is connected to the second hydraulic receiving portion 75*b*.

That is, the first control valve 56B is switched between a neutral position, a first position different from the neutral position, and a second position different from the neutral position and the first position due to the difference in the pilot pressures of the operation fluid applied to the first hydraulic receiving portion 75*a* and the second hydraulic receiving portion 75*b*.

The branched fluid tube 64 includes a third branched fluid tube 64*c* confluent with (connected to) the first operation fluid tube 46*a* and a fourth branched fluid tube 64*d* confluent with (connected to) the second operation fluid tube 46*b*.

The electromagnetic valve 65 includes a third electromagnetic valve 65*c* connected to the third branched fluid tube 64*c* and a fourth electromagnetic valve 65*d* connected to the fourth branched fluid tube 64*d*. The third solenoid valve 65*c* connects the output side thereof to the third branched fluid tube 64*c*. The fourth solenoid valve 65*d* connects the outlet side thereof to the fourth branched fluid tube 64*d*. When the opening aperture of the solenoid valve 65 is changed from the fully closed state, the operation fluid tubes 46*a* and 46*b* are connected to the first hydraulic pump P1.

That is, the operation fluid can be applied from the hydraulic pump P1 to the first control valve 56A through the solenoid valve 65. Specifically, the operation fluid outputted from the hydraulic pump P1 can be applied to the operation fluid tubes 46*a* and 46*b* through the solenoid valve 65 and the branched fluid tube 64. In this manner, the operation fluid outputted by the hydraulic pump P1 can be applied to the first control valve 56A.

The changing portion 51 includes the shuttle valves 87 and 88. The shuttle valves 87 and 88 are provided in a confluent portion 66 of the operation fluid tubes 46*a* and 46*b* and the branched fluid tube 64. Further, the shuttle valves 87 and 88 communicates the pilot valves 55C and 55D and the first control valve 56A with each other, and has a first position and a second position, the first position regulating the operation fluid between the solenoid valve 65 and the first control valve 56A, the second position regulating the operation fluid between the pilot valves 55C and 55D and the first control valve 56A and communicating the solenoid valve 65 and the first control valve 56A with each other.

The shuttle valves 87 and 88 will be specifically described. The shuttle valves 87 and 88 include a third shuttle valve 87 and a fourth shuttle valve 88. The confluent portion 66 includes a third confluent portion 66*c* and a fourth confluent portion 66*d*.

The third shuttle valve 87 is provided in a third confluent portion 66*c* where the first operation fluid tube 46*a* and the third branched fluid tube 64*c* are confluent with each other. The third shuttle valve 87 communicates the pilot valve 55C and the first control valve 56A with each other, and has a first position and a second position, the first position regulating the operation fluid between the third solenoid valve 65*c* and the first control valve 56A, the second position regulating the operation fluid between the pilot valve 55C and the first control valve 56A and communicating the third solenoid valve 65*c* and the first control valve 56A with each other.

That is, in the case where the pressure of the operation fluid applied from the pilot valve 55C to the third shuttle valve 87 is larger than the pressure of the operation fluid applied from the third solenoid valve 65*c* to the third shuttle valve 87, the pressure of the operation fluid set by the pilot valve 55C is applied to the first hydraulic receiving portion 75*a*. In that case, the operation fluid applied from the third electromagnetic valve 65*c* to the third shuttle valve 87 does not apply a pressure to the first hydraulic receiving portion 75*a*.

On the other hand, in the case where the pressure of the operation fluid applied from the third solenoid valve 65*c* to the third shuttle valve 87 is larger than the pressure of the operation fluid applied from the third solenoid valve 65*c* to the third shuttle valve 87, the pressure of the operation fluid set by the third solenoid valve 65*c* is applied to the first hydraulic receiving portion 75*a*. In that case, the operation fluid applied from the pilot valve 55C to the third shuttle valve 87 does not apply a pressure to the first hydraulic receiving portion 75*a*.

The fourth shuttle valve 88 is provided in a fourth confluent portion 66*d* where the second operation fluid tube 46*b* and the fourth branched fluid tube 64*c* are confluent with each other. The fourth shuttle valve 88 communicates the pilot valve 55D and the first control valve 56A with each other, and has a first position and a second position, the first position regulating the operation fluid between the fourth solenoid valve 65*d* and the first control valve 56A, the second position regulating the operation fluid between the pilot valve 55D and the first control valve 56A and communicating the fourth solenoid valve 65*d* and the first control valve 56A with each other.

That is, in the case where the pressure of the operation fluid applied from the pilot valve 55D to the fourth shuttle valve 88 is larger than the pressure of the operation fluid applied from the fourth solenoid valve 65*d* to the fourth shuttle valve 88, the pressure of the operation fluid set by the pilot valve 55D is applied to the second hydraulic receiving portion 75*b*. In that case, the operation fluid applied from the fourth electromagnetic valve 65*d* to the fourth shuttle valve 88 does not apply a pressure to the second hydraulic receiving portion 75*b*.

On the other hand, in the case where the pressure of the operation fluid applied from the fourth solenoid valve 65*d* to the fourth shuttle valve 88 is larger than the pressure of the operation fluid applied from the pilot valve 55D to the fourth shuttle valve 88, the pressure of the operation fluid set by the fourth solenoid valve 65*d* is applied to the second hydraulic receiving portion 75*b*. In that case, the operation fluid applied from the pilot valve 55D to the fourth shuttle valve 88 does not apply a pressure to the second hydraulic receiving portion 75*b*.

A bypass check valve 96 is provided between the outlet side of the third shuttle valve 87 in the first operation fluid tube 46*a* and the first hydraulic receiving portion 75*a*. Another bypass check valve 96 is provided between the outlet side of the fourth shuttle valve 88 in the second operation fluid tube 46*b* and the second hydraulic receiving portion 75*b*.

The bypass check valve 96 allows the operation fluid to flow from the pilot valve to the first control valve. In addition, the bypass check valve 96 prevents the operation fluid from flowing from the first control valve to the pilot valve. A bypass fluid tube 95 is provided on the inlet side and the outlet side of the bypass check valve 96. In the bypass fluid tube 95, a throttle 97 is provided.

The changing portion 51 has an input device 93. The input device 93 is connected to the control device 90. The input device 93 includes a plurality of slide switches 93*a* and 93*b*. In particular, the input device 93 is a device configured to change the supply amount of operation fluid supplied to the first control valve 56A and the second control valve 56B, that is, the supply amount of operation fluid outputted from the solenoid valve 65.

In other words, the input device 93 is an operating device configured to set the opening aperture of the solenoid valve 65 connected to the control valves 56A and 56B.

The slide switches 93*a* and 93*b* are variable resistors configured to detect the extent of the movement (the operation extent) such as a slide volume, for example. The operation signals of the slide switches 93*a* and 93*b* are inputted to the control device 90. For example, when the slide switch 93*a* is slid in one direction, the control device 90 controls to open the first solenoid valve 65*a* related to the slide switch 93*a*.

When the slide switch 93*a* is slid in the other direction, the control device 90 controls to open the second solenoid valve 65*b*. That is, when the slide switch 93*a* is operated, the bucket 11 can be operated by the second control valve 56B and the bucket cylinder 15.

In addition, when the slide switch 93*b* is slid in one direction, the control device 90 controls to open the third solenoid valve 65*c* related to the slide switch 93*b*. When the slide switch 93*b* is slid in the other direction, the control device 90 controls to open the fourth solenoid valve 65*d*.

That is, when the slide switch 93*b* is operated, the boom 10 can be operated through the first control valve 56A and the boom cylinder 14.

Meanwhile, the input device 93 is not limited to the slide switches 93*a* and 93*b*, and may be constituted of any device configured to input a signal to the control device 90. For example, in the case where the operation device is constituted of the push switch, the input device 93 may be constituted of a device to control the operation-target solenoid valve 65 to open at a predetermined aperture when the push switch is pushed.

In addition, the operation targets of the slide switches 93*a* and 93*b* are not limited to the boom 10 or the bucket 11. The operation target may be any hydraulic device provided in the working machine 1.

In this manner, the operator can operate the boom cylinder 14 and the bucket cylinder 15 with the two systems of the hydraulic system and the electric system, the hydraulic system operating the pilot valves 55C, 55D, 59C, and 59D by the operation of the first operation member 54 and the second operation member 58, the electric system operating the control device 90 and the solenoid valve 65 by operation of the plurality of slide switches 93*a* and 93*b*.

That is, the hydraulic system for the working machine 1 is provided with a hydraulic system excellent in operability and durability, as well as an electric system configured to be operated finely and has versatility. That is, the hydraulic system of the working machine 1 has two operating systems. The hydraulic system for working according to the fourth embodiment may be adopted to the hydraulic system for traveling.

The hydraulic system for the working machine 1 described above includes the input device 93. The control device 90 controls the solenoid valve 65 in accordance with the operation of the input device 93. In this manner, the operator can operate the first hydraulic device 56B by operating the input device 93.

Thus, the first hydraulic device 56B can be operated through the two systems of the hydraulic system which operates the operation valves 59C and 59D by operation of the operation member 58 and the electric system which operates the control device 90 and the solenoid valve 65 by operation of the input device 93.

That is, the hydraulic system of the working machine 1 is provided with a hydraulic system excellent in durability and operability, as well as an electric system which is configured to perform fine operation and has excellent versatility. As described above, the hydraulic system of the working machine 1 has two operating systems.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modified examples within and equivalent to a scope of the claims.

What is claimed is:

1. A hydraulic system for a working machine, comprising:

a hydraulic pump to output an operation fluid to an outputting fluid tube;

a hydraulic device having first and second hydraulic receiving portions;

a first pilot valve to regulate a first pilot pressure of the operation fluid supplied to the first hydraulic receiving portion upon first operation of a hydraulic member;

a second pilot valve to regulate a second pilot pressure of the operation fluid supplied to the second hydraulic receiving portion upon second operation of the hydraulic member;

a first supply fluid tube for fluid communication between the first pilot valve and the first hydraulic receiving portion;

a second supply fluid tube for fluid communication between the second pilot valve and the second hydraulic receiving portion;

a branched fluid tube for fluid communication between the first supply fluid tube and second supply fluid tube;

a first shuttle valve provided at a first confluence of the first supply fluid tube and the branched fluid tube;

a second shuttle valve provided at a second confluence of the second supply fluid tube and the branched fluid tube; and a proportional valve provided in the outputting fluid tube to regulate a counteracting pressure of the operation fluid flowing both into the first confluence and the second confluence through the branched fluid tube.

2. The hydraulic system according to claim 1, wherein the proportional valve regulates the counteracting pressure to be changed continuously.

3. The hydraulic system according to claim 1, wherein when the counteracting pressure is less than the first pilot pressure and greater than the second pilot pressure, the operation fluid of the first pilot pressure is supplied to the first hydraulic receiving portion and the operation fluid of the counteracting pressure is supplied to the second hydraulic receiving portion.

4. The hydraulic system according to claim 1, wherein the proportional valve regulates the counteracting pressure to be changed simultaneously at the first shuttle valve and the second shuttle valve.

5. The hydraulic system according to claim 1, further comprising:

a first discharging fluid tube with a first throttle for discharging the operation fluid in the first supply fluid tube to a tank; and a second discharging fluid tube with a second throttle for discharging the operation fluid in the second supply fluid tube to the tank.

6. The hydraulic system according to claim 1, further comprising:

a first check valve to allow a flow of the operation fluid from the first shuttle valve to the hydraulic device and to block the flow of the operation fluid from the hydraulic device to the first shuttle valve;

a first bypass fluid tube for connection across upstream and downstream sides of the first check; and a third throttle provided in the first bypass fluid tube.

7. The hydraulic system according to claim 1, further comprising:

a second check valve to allow a flow of the operation fluid from the second shuttle valve to the hydraulic device and to block the flow of the operation fluid from the hydraulic device to the second shuttle valve;

a second bypass fluid tube for connection across upstream and downstream sides of the second check; and a fourth throttle provided in the second bypass fluid tube.

8. The hydraulic system according to claim 1, further comprising:

a controller to control the proportional valve; and a slide switch to input a signal to the controller;

wherein the controller controls the proportional valve in accordance with the signal received from the slide switch.

* * * * *